US008684485B2

(12) United States Patent
Sato et al.

(10) Patent No.: US 8,684,485 B2
(45) Date of Patent: Apr. 1, 2014

(54) PRINTING DEVICE, METHOD FOR CONTROLLING PRINTING DEVICE, AND COMPUTER PROGRAM

(75) Inventors: Akito Sato, Nagano (JP); Bunji Ishimoto, Nagano (JP); Takahide Miyashita, Nagano (JP); Katsuhiko Sugiyama, Nagano (JP); Yasuhiro Takeuchi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 330 days.

(21) Appl. No.: 13/078,058

(22) Filed: Apr. 1, 2011

(65) Prior Publication Data

US 2011/0242177 A1 Oct. 6, 2011

(30) Foreign Application Priority Data

Apr. 6, 2010 (JP) ..... 2010-087542
Apr. 6, 2010 (JP) ..... 2010-087544

(51) Int. Cl.

| | |
|---|---|
| ***B41J 2/205*** | (2006.01) |
| *B41J 29/38* | (2006.01) |
| *B41J 2/015* | (2006.01) |
| *B41J 2/15* | (2006.01) |
| *B41J 2/145* | (2006.01) |

(52) U.S. Cl.
USPC ..... 347/15; 347/5; 347/12; 347/14; 347/20; 347/40; 347/41

(58) Field of Classification Search
USPC ..... 347/5, 12, 14, 15, 20, 40, 41
See application file for complete search history.

(56) References Cited

U.S. PATENT DOCUMENTS

| | | | | |
|---|---|---|---|---|
| 5,075,689 | A * | 12/1991 | Hoisington et al. | 347/41 |
| 5,600,353 | A * | 2/1997 | Hickman et al. | 347/43 |
| 5,692,843 | A * | 12/1997 | Furuya | 400/120.02 |
| 5,767,876 | A * | 6/1998 | Koike et al. | 347/43 |
| 6,209,987 | B1 * | 4/2001 | Katayama | 347/43 |
| 6,257,698 | B1 * | 7/2001 | Bloomberg et al. | 347/40 |
| 6,530,635 | B2 * | 3/2003 | Otsuki | 347/9 |
| 6,533,393 | B1 * | 3/2003 | Meyer et al. | 347/43 |
| 6,597,466 | B1 * | 7/2003 | Katayama | 358/1.13 |
| 6,629,744 | B2 * | 10/2003 | Otsuki | 347/15 |

(Continued)

FOREIGN PATENT DOCUMENTS

| | | | |
|---|---|---|---|
| JP | 03-503146 | A | 7/1991 |
| JP | 2001-162841 | A | 6/2001 |

(Continued)

*Primary Examiner* — Laura Martin
*Assistant Examiner* — Jeremy Bishop
(74) *Attorney, Agent, or Firm* — Global IP Counselors, LLP

(57) ABSTRACT

A printing device includes a nozzle row for chromatic ink comprising K nozzles and a nozzle row for achromatic ink comprising (n·K) nozzles. In a color region, an image-forming operation is performed m times in which the movement direction of the nozzle rows switches alternately between forward and reverse directions, whereby a region of the image having a predetermined width is formed. The image-forming operation performed m times includes the image-forming operation performed once in which both of the nozzle rows for chromatic ink and for achromatic ink are used, and the image-forming operation performed (m−1) times in which only the nozzle row for chromatic ink is used. In a monochrome region, the image-forming operation is performed once in which only the nozzle row for achromatic ink is used, whereby a region of the image having a predetermined width is formed.

7 Claims, 12 Drawing Sheets

(56) References Cited

U.S. PATENT DOCUMENTS

| | | | | |
|---|---|---|---|---|
| 6,655,783 | B2 * | 12/2003 | Otsuki | 347/43 |
| 6,682,169 | B2 | 1/2004 | Otsuki | |
| 6,688,727 | B2 * | 2/2004 | Otsuki | 347/41 |
| 6,705,695 | B2 * | 3/2004 | Otsuki | 347/9 |
| 6,948,796 | B2 * | 9/2005 | Otsuki | 347/41 |
| 7,407,277 | B2 | 8/2008 | Yoneyama | |
| 8,070,256 | B2 * | 12/2011 | Sudo | 347/43 |
| 8,408,669 | B2 * | 4/2013 | Rueby | 347/14 |
| 2001/0006392 | A1 | 7/2001 | Otsuki | |
| 2003/0112284 | A1 | 6/2003 | Otsuki | |
| 2008/0151001 | A1 | 6/2008 | Sudo et al. | |

FOREIGN PATENT DOCUMENTS

| | | | |
|---|---|---|---|
| JP | 2006-231930 | A | 9/2006 |
| JP | 2008-155377 | A | 7/2008 |
| JP | 2008-155378 | A | 7/2008 |
| WO | 90/14957 | A1 | 12/1990 |

* cited by examiner

PRINTING DEVICE, METHOD FOR CONTROLLING PRINTING DEVICE, AND COMPUTER PROGRAM

CROSS-REFERENCE TO RELATED APPLICATIONS

This application claims priority to Japanese Patent Application No. 2010-087542 filed on Apr. 6, 2010 and Japanese Patent Application No. 2010-087544 filed on Apr. 6, 2010. The entire disclosure of Japanese Patent Application Nos. 2010-087542 and 2010-087544 are hereby incorporated herein by reference.

BACKGROUND

1. Technical Field

The present invention relates to printing in which ink is discharged and an image is formed on a print medium.

2. Related Art

In recent years, there has been a growing prevalence of printing devices in which ink is discharged from a nozzle provided to a printing head and an ink dot is formed on a print medium while main scanning, where a printing head is moved in a reciprocating manner, is performed; whereby an image is printed. There is disclosed a technique in which, in a printing device of such description, a row of achromatic ink nozzles for discharging achromatic ink (e.g., black ink) and a row of chromatic ink nozzles for discharging chromatic ink (e.g., cyan ink, magenta ink, yellow ink) are used to form a color region that contains chromatic colors in a printed image, and only the nozzle row for achromatic ink is used to form a monochrome region that does not contain chromatic colors in the printed image (e.g., see JP-A 2006-231930).

SUMMARY

According to the conventional technique, there has been a room for improvement, both in terms of improving print image quality and inhibiting an increase in time required for print processing. In particular, according to the conventional technique, there has been scope for improvement, both in terms of inhibiting an increase in positional displacement along a main scanning direction of a line substantially parallel to the direction of conveyance of the print medium (i.e., a sub-scanning direction) formed using achromatic ink, thereby improving print image quality; and inhibiting an increase in time required for print processing.

In order to solve the above-mentioned problem, an object of the present invention is to inhibit an increase in time required for print processing and increasing print image quality when performing print processing in which ink is discharged and an image is formed on a print medium.

In order to solve at least a part of the above-mentioned problem, the present invention may be achieved as an embodiment or an example of application described as follows.

A printing device according to a first aspect includes a plurality of nozzle rows, a conveyance mechanism, and a control part. The nozzle rows contains a nozzle row for chromatic ink and a nozzle row for achromatic ink, the nozzle row for chromatic ink having K nozzles for discharging chromatic ink arranged in a first direction (where K is an integer equal to or greater than 2), the nozzle row for achromatic ink having (n·K) nozzles for discharging achromatic ink arranged in the first direction (where n is an integer equal to or greater than 2), and the nozzle rows being arranged along a second direction that intersects with the first direction; a movement mechanism for causing the nozzle rows to move relative to a print medium in a reciprocating manner along the second direction. The conveyance mechanism is configured and arranged to convey the print medium relative to the nozzle rows along the first direction. The control part is configured to repeatedly perform an image-forming operation in which the nozzle rows discharge ink while the movement mechanism moves the nozzle rows in a forward direction and reverse direction, and a conveying operation in which the conveyance mechanism conveys the print medium, thereby forming an image on the print medium. In a color region of the image in which the color region contains a chromatic color, the control part is configured to perform the image-forming operation m times (where m is an integer equal to or greater than 2 and equal to or less than n) in which the direction of movement of the nozzle rows switches alternately between the forward direction and the reverse direction, whereby a region of the image having a predetermined width is formed along the first direction, the image-forming operation performed m times including the image-forming operation performed once in which the direction of movement of the nozzle rows is a predetermined direction that is either one of the forward direction or the reverse direction and in which both of the nozzle row for chromatic ink and the nozzle row for achromatic ink are used, and the image-forming operation performed (m−1) times in which only the nozzle row for chromatic ink is used. In a monochrome region of the image in which the monochrome region does not contains a chromatic color, the control part is configured to perform the image-forming operation once in which only the nozzle row for achromatic ink is used, whereby a region of the image having a predetermined width is formed.

According to this printing device, in the color region, the direction of the image-forming operation in which the nozzle row for achromatic ink is used is always in the same direction. Therefore, it is possible to inhibit occurrence of positional displacement, along the second direction, of a ruled line formed using achromatic ink so as to be substantially parallel to the first direction, and to improve print image quality. Also, according to this printing device, the number of nozzles forming the nozzle row for achromatic ink is n times the number of nozzles forming the row of chromatic ink nozzle, and in the color region, the image-forming operation performed once in which both the nozzle row for chromatic ink and the nozzle row for achromatic ink, and the image-forming operation performed (m−1) times in which only the nozzle row for chromatic ink is used, form the region of the image having a predetermined width along the first direction. Therefore, it is possible to inhibit an increase in time required for print processing even though the direction of the image-forming operations in which the nozzle row for achromatic ink is used is always in the same direction. Therefore, according to this printing device, it is possible to improve print image quality while inhibiting an increase in time required for print processing.

A printing device according to a second aspect is the printing device according to the first aspect, wherein among the image-forming operation performed m times by the control part, the first image-forming operation in which the direction of movement of the nozzle rows is preferably in the predetermined direction is the image-forming operation performed once in which both of the nozzle row for chromatic ink and the nozzle row for achromatic ink are used.

According to this printing device, of the image-forming operation performed m times, the first image-forming operation in which the direction of movement of the nozzle rows is in the predetermined direction is an image-forming operation performed once in which both the nozzle row for chromatic ink and the nozzle row for achromatic ink are used. Therefore, the nozzle row for achromatic ink is used when the amount of ink on the print medium and the deflection of the print medium are relatively small, and it is possible to inhibit occurrence of positional displacement of a ruled line in an effective manner.

A printing device according to a third aspect is the printing device according to the first or second aspects, wherein the value of n is preferably an even number.

This printing device makes it possible to simplify, and thereby speed up, the process.

A printing device according to a fourth aspect is the printing device according to any of first through third aspects, wherein the control part is preferably configured to perform formation of the image so that the predetermined direction is in the same direction for all color regions in the image.

In this printing device, in the color region, the direction of the image-forming operation in which the nozzle row for achromatic ink is used is always in the same direction. Therefore, it is possible to inhibit occurrence of positional displacement, along the second direction, of a ruled line formed using achromatic ink so as to be substantially parallel to the first direction, and to improve print image quality. Also, according to this printing device, in all color regions in the image, the direction of the image-forming operation in which both the nozzle row for chromatic ink and the nozzle row for achromatic ink are used (i.e., the predetermined direction) is in the same direction. Therefore, the sequence in which achromatic ink and chromatic ink overlap each other on the print medium can be made constant, and color unevenness can be prevented from occurring. Also, according to this printing device, the number of nozzles forming the nozzle row for achromatic ink is n times the number of nozzles forming the row of chromatic ink nozzle, and in the color region, the image-forming operation performed once in which both the nozzle row for chromatic ink and the nozzle row for achromatic ink, and the image-forming operation performed (m−1) times in which only the nozzle row for chromatic ink is used, form the region of the image having a predetermined width along the first direction. Therefore, it is possible to inhibit an increase in time required for print processing even though the direction of the image-forming operations in which the nozzle row for achromatic ink is used is always in the same direction. Therefore, according to this printing device, it is possible to improve print image quality while inhibiting an increase in time required for print processing.

A printing device according to a fifth aspect is the printing device according to the fourth aspect, wherein in an instance where a region having a predetermined width, being positioned in the monochrome region of the image, and being positioned immediately before a boundary with the color region, has been formed using the image-forming operation in which the direction of movement of the nozzle rows is in the predetermined direction, the control part is preferably configured to perform, immediately after the image-forming operation for forming the region having the predetermined width and being positioned immediately before the boundary, a movement of the nozzle rows in a direction opposite the predetermined direction without use of the nozzle rows, and then to perform image formation in the color region.

According to this printing device, in all color regions in the image, the direction of the image-forming operation in which both the nozzle row for chromatic ink and the nozzle row for achromatic ink are used (i.e., the predetermined direction) can be made so as to be always in the same direction.

A printing device according to a sixth aspect is the printing device according to the fourth aspect, wherein in an instance where a region having a predetermined width, being positioned in the monochrome region of the image, and being positioned immediately before a boundary with the color region, has been formed using the image-forming operation in which the direction of movement of the nozzle rows is in the predetermined direction, the control part is preferably configured to perform, immediately after the image-forming operation for forming the region having the predetermined width and being positioned immediately before the boundary, the image-forming operation in which the direction of movement of the nozzle rows is opposite the predetermined direction, and in which only the nozzle row for chromatic ink is used, as one of the image-forming operations performed (m−1) times for image formation in the color region.

According to this printing device, in all color regions in the image, the direction of the image-forming operation in which both the nozzle row for chromatic ink and the nozzle row for achromatic ink are used (i.e., the predetermined direction) can be made so as to be always in the same direction.

The present invention can be achieved through a variety of embodiments. For example, the present invention can be achieved in the forms of a printing method and printing device; method and device for controlling printing device; printing system; a computer program for achieving the methods, devices, or system described above; a recording medium for recording the computer program; or a data signal containing the computer program and embodied within a transmitted wave.

DESCRIPTION OF THE DRAWINGS

Referring now to the attached drawings which form a part of this original disclosure.

DETAILED DESCRIPTION OF EXEMPLARY EMBODIMENTS

An embodiment of the present invention will now be described using examples in the following sequence: A. First example (A-1. Configuration of printing device, A-2. Recording method); B. Second example; C. Third example; D. Fourth example; and E. Example of modification.

A. FIRST EXAMPLE

A-1. Configuration of Printing Device

Figure 1:
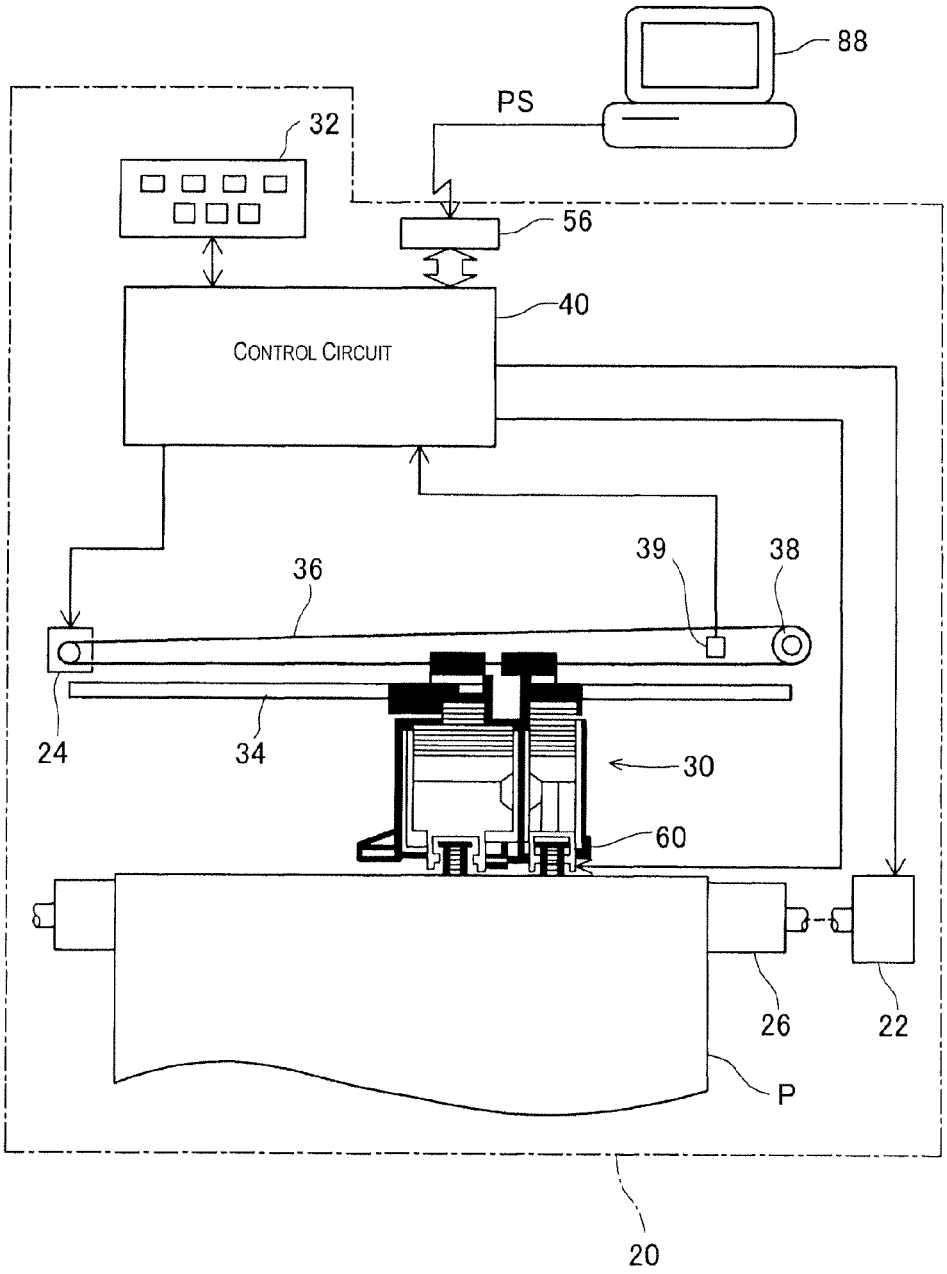
FIG. 1 is a schematic configuration drawing showing a printing system according to a first example of the present invention.

FIG. 1 is a schematic configuration drawing showing a printing system according to a first example of the present invention. The printing system comprises an ink-jet printer 20, and a computer 88 for feeding a printing signal PS to the ink-jet printer 20. The ink-jet printer 20 is connected to the computer 88 via a connector 56.

The ink-jet printer 20 comprises a movement mechanism for performing a main scan, in which a carriage 30 is caused to move in a reciprocating manner along a direction parallel to a shaft of a platen 26; a conveyance mechanism for performing a sub-scan, in which a print medium in the form of a paper sheet P is conveyed in a direction that intersects the main scanning direction (i.e., a sub-scanning direction); a printing head unit 60 installed on the carriage 30; and a control circuit 40 for controlling each part of the ink-jet printer 20.

The conveyance mechanism for conveying the paper sheet P comprises a paper feed motor 22; and a gear train (not shown) for transmitting rotation of the paper feed motor 22 to a paper conveyance roller (not shown). Rotation of the paper feed motor 22 is transmitted to the paper conveyance roller, and rotation of the paper conveyance roller conveys the paper sheet P. Also, the movement mechanism for causing the carriage 30 to move in a reciprocating manner includes a carriage motor 24; a sliding shaft 34, installed parallel to the shaft of the platen 26, for slidably holding the carriage 30; a pulley 38 for providing an endless driving belt 36 in a tensioned state between the pulley 38 and the carriage motor 24; and a position detecting sensor 39 for detecting a position of an origin of the carriage 30. Rotation of the carriage motor 24 is transmitted to the carriage 30 via the endless driving belt 36, thereby causing the carriage 30 to move in a reciprocating manner along the sliding shaft 34. A direction parallel to the main scanning direction corresponds to the second direction in the present invention, and a direction parallel to the sub-scanning direction corresponds to the first direction in the present invention.

Figure 2:
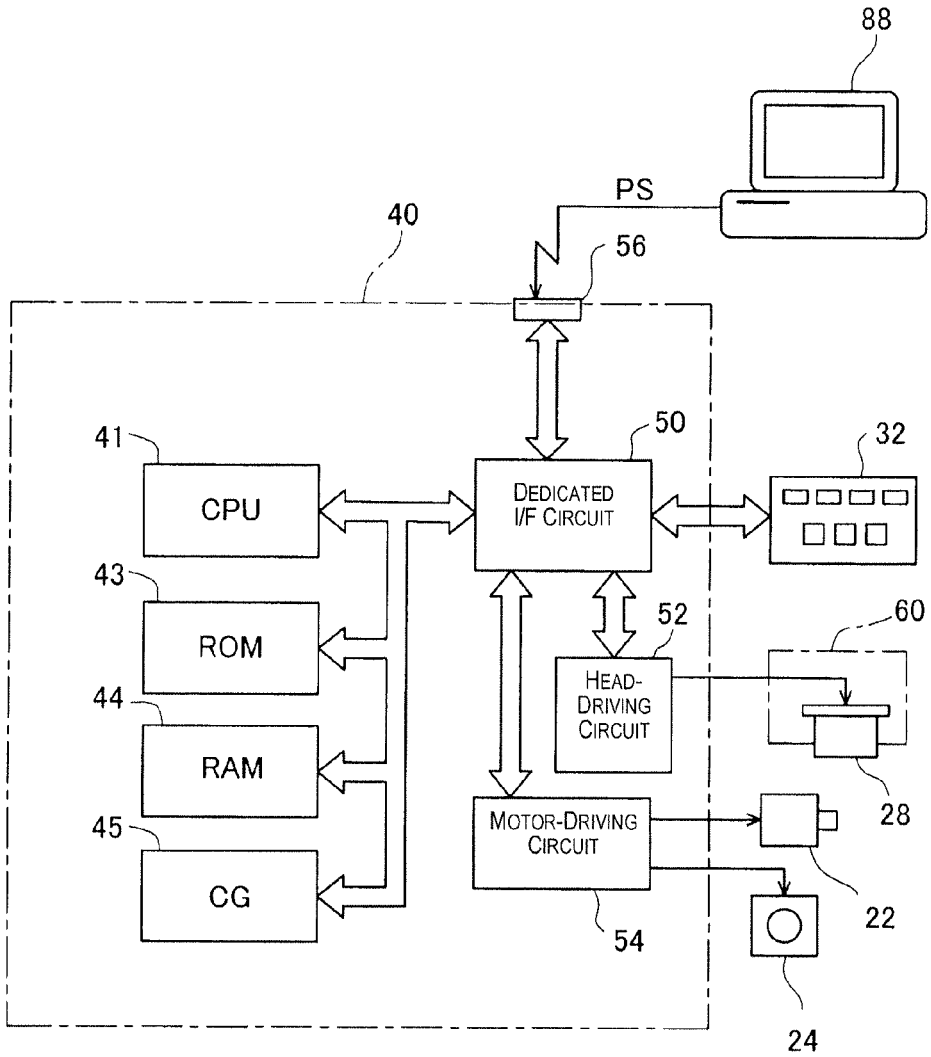
FIG. 2 is a block diagram showing a configuration of an ink-jet printer 20 centered around a control circuit 40 according to the first example.

FIG. 2 is a block diagram showing a configuration of the ink-jet printer 20 centered around a control circuit 40 according to the first example. The control circuit 40 is configured as an arithmetic logic unit comprising a CPU 41, a ROM 43, a RAM 44, and a character generator (CG) 45 in which dot matrices of print characters are stored. The control circuit 40 further comprises a dedicated I/F circuit 50, which is an interface with an external motor or another external device; a head-driving circuit 52, connected to the dedicated I/F circuit 50, for driving the printing head unit 60; and a motor-driving circuit 54 for driving the paper feed motor 22 and the carriage motor 24. The dedicated I/F circuit 50 receives the printing signal PS fed from the computer 88 via the connector 56. The CPU 41 executes a computer program stored in the ROM 43, thereby causing the control circuit 40 as a control part for controlling the ink-jet printer 20.

The printing head unit 60 comprises a printing head 28. The printing head 28 has a plurality of rows of nozzles for discharging ink (described further below), and an actuator circuit for operating piezoelectric elements provided to each nozzle forming each of the nozzle rows. The actuator circuit is a part of the head-driving circuit 52, and performs an ON/OFF control of a drive signal fed from a drive signal generation circuit (not shown) in the head-driving circuit 52. Specifically, the actuator circuit latches dot data representing an ON state (in which ink is discharged) and an OFF state (in which ink is not discharged) with regards to each of the nozzles in accordance with a print signal PS fed from the computer 88, and applies the drive signal to the piezoelectric element with regards to nozzles in an ON state only.

Figure 3:
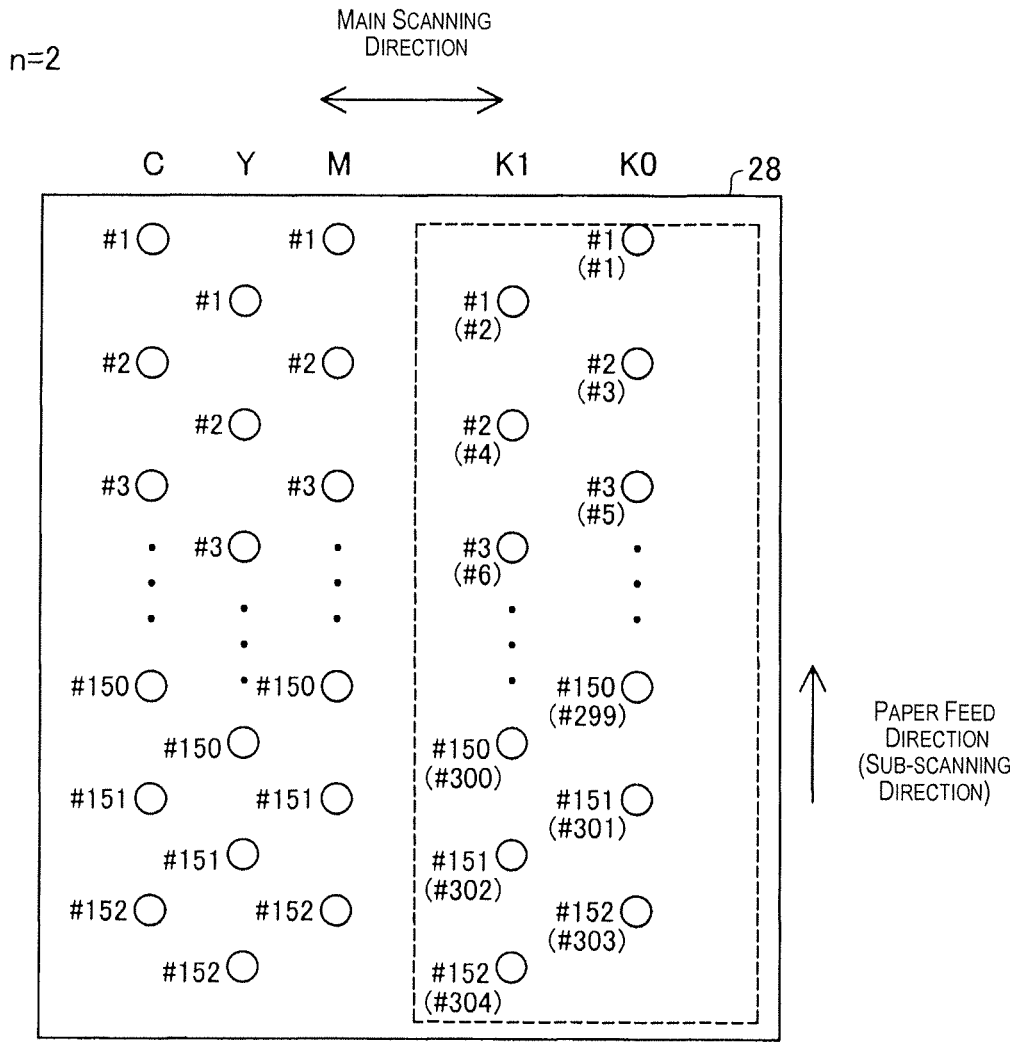
FIG. 3 is a descriptive drawing showing a layout of nozzles provided to a printing head 28 of the ink-jet printer 20 according to the first example.

FIG. 3 is a descriptive drawing showing a layout of nozzles provided to a printing head 28 of the ink-jet printer 20 according to the first example. The ink-jet printer 20 according to the first example performs printing using four colors of ink: black (K), cyan (C), magenta (M), and yellow (Y). Therefore, the printing head 28 has a plurality of nozzle rows corresponding to the four colors of ink, arranged along the main scan direction. Specifically, the printing head 28 has, with regards to each of the three types of chromatic ink (i.e., cyan ink, yellow ink, magenta ink), one nozzle row comprising 152 nozzles arranged along the sub-scan direction (represented by C, Y, and M respectively in FIG. 3); and with regards to the achromatic ink (i.e., black ink), two nozzle rows comprising 152 nozzles arranged along the sub-scan direction (represented by K0 and K1 in FIG. 3).

As shown in FIG. 3, the nozzle pitch in each of the nozzle rows is identical. With regards to position along the sub-scan direction, the nozzle row for cyan ink and the nozzle row for magenta ink are positioned in line with one of the nozzle rows for black ink (K0), and the nozzle row for yellow ink and the other nozzle row for black ink (K1) are positioned to as to be displaced by half the nozzle pitch relative to the nozzle row for cyan ink, the nozzle row for magenta ink, and the one of the nozzle rows for black (K0). The two nozzle rows for black ink can also be interpreted as one nozzle row comprising 304 nozzles in a 'staggered arrangement', as indicated by nozzle numbers in parentheses in FIG. 3. According to this interpretation, if K represents the number of nozzles forming each of the nozzle rows for chromatic ink, the number of nozzles forming the nozzle row for black ink is (n·K), where n=2. In other words, the number of nozzles forming the nozzle row for black ink is twice the number of nozzles forming the nozzle row for chromatic ink. Also, the nozzle pitch of the nozzle row for black ink is twice as fine as the nozzle pitch of each of the nozzle rows for chromatic ink.

Thus, the two nozzle rows for black ink can be interpreted as one nozzle row in a staggered arrangement. Also, in the example shown in FIG. 3, in each of the nozzle rows for chromatic ink on the printing head 28, the position of each of the nozzles forming the nozzle row is the same along the main scan direction (i.e., the nozzles are in a linear arrangement). However, each of the nozzle rows for chromatic ink may also be in a 'staggered arrangement'. In other words, in these specifications, a "nozzle row" refers to a plurality of nozzles arranged along the sub-scan direction; and "a plurality of nozzles arranged along the sub-scan direction" refers to a plurality of nozzles arranged so that the position of each of the nozzles is different along the sub-scan direction, irrespective of the position of each of the nozzles in the main scan direction.

The printing head unit 60 having the printing head 28 is installed in the carriage 30. Therefore, the printing head 28 is moved, by the carriage motor 24 (see FIG. 1), in a reciprocating manner along the sliding shaft 34 (i.e., along the main scan direction) relative to the print medium. Also, the paper sheet P is conveyed by the paper feed motor 22 in the paper feed direction (i.e., the sub-scan direction) relative to the printing head 28.

In the ink jet printer 20 having the configuration described above according to the present invention, the control circuit 40 repeatedly performs an image-forming operation, in which the control circuit 40 causes the printing head unit 60 to discharge ink while causing the movement mechanism to move the carriage 30 installed with the printing head unit 60 in a reciprocating manner, and a conveying operation in which the control circuit 40 causes the conveyance mechanism to convey the paper sheet P, and thereby performs print processing in which an image is formed on the paper sheet P. Based on a printing signal PS received from the computer 88, the ink jet printer 20 performs color conversion processing and half tone processing, and generates dot data representing the ON/OFF states of each of the nozzles in print processing. Known processes are used for the processing treatments described above, and a description of the processing treatments is not provided.

A-23. Recording Method

Figure 4:
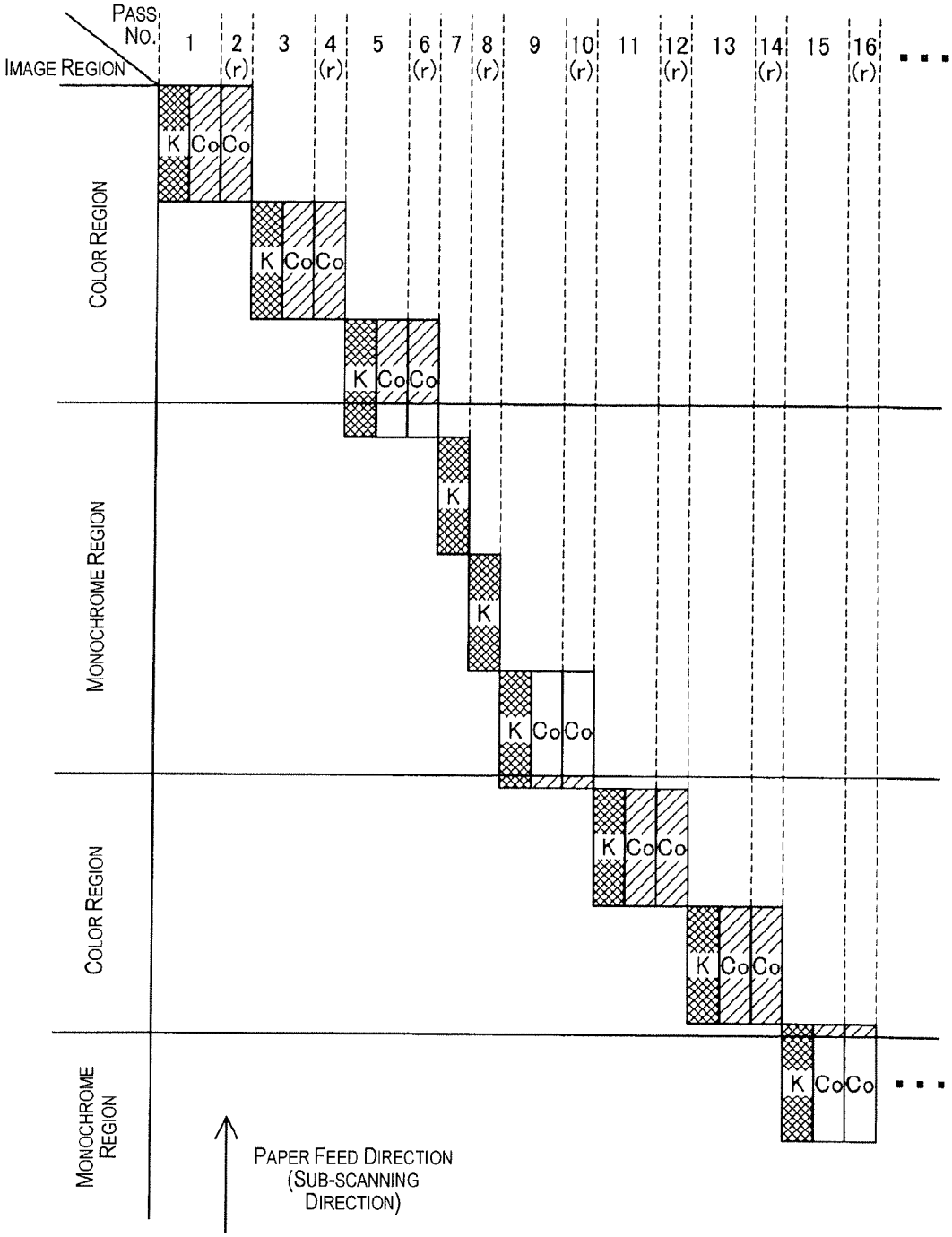
FIG. 4 is a descriptive drawing showing an example of a recording method in print processing performed by the ink-jet printer 20 according to the first example.

FIG. 4 is a descriptive drawing showing an example of a recording method in print processing performed by the ink-jet printer 20 according to the first example. FIG. 4 shows positions along the sub-scan direction of a nozzle row used during each pass for forming each image region when the printed image is divided along the sub-scan direction (i.e., the paper feed direction) into a color region, which is an image region containing chromatic colors, and a monochrome region, which is an image region that does not contain chromatic colors.

A "pass" here refers to an action in which the movement mechanism described above moves the printing head 28 comprising each of the nozzle rows (see FIG. 3) in a forward direction or a reverse direction along the main scan direction. In FIG. 4, passes affixed with a letter r next to the pass number are those in which the printing head 28 is moved in the reverse direction, and the remaining passes are those in which the printing head 28 is moved in the forward direction. The forward direction refers to a direction of movement from a home position that has been established beforehand in the vicinity of one end of a movement path of the carriage 30 towards the vicinity of another end; and the reverse direction refers to a direction opposite the forward direction. In each of the passes marked with the letter K, a nozzle row for black ink is used in a position along the sub-scan direction of a rectangle marked with the letter K; and in each of the passes marked with letters Co, a nozzle row for chromatic ink is used in a position along the sub-scan direction of a rectangle marked with the letters Co. In each of the passes, in an instance in which marking with the letter K is not present, a nozzle row for black ink is not used; and in an instance in which marking with letters Co is not present, a nozzle row for chromatic ink is not used. The significance of having a nozzle row for black ink or a nozzle row for chromatic ink used in each of the passes is that ink having a corresponding color is discharged from a corresponding nozzle row in an instance in which the dot data corresponding to the pass contains data indicating that black ink or chromatic ink is to be discharged. Even in an instance in which a nozzle row for black ink or a nozzle row for chromatic ink is used in a given pass, ink having a corresponding color is not discharged from a corresponding nozzle row in an instance in which the dot data corresponding to the pass does not contain data indicating that black ink or chromatic ink is to be discharged. Also, a pass in which a nozzle row for black ink or a nozzle row for chromatic ink is used corresponds to an image-forming operation described above. As described further below, a pass may be one in which neither a nozzle row for black ink nor a nozzle row for chromatic ink is used (i.e., an empty pass).

In the example shown in FIG. 4, the printed image sequentially comprises a color region, a monochrome region, a color region, a monochrome region, and so on. Therefore, in the print processing, image formation is first performed in a color region. In the first color region, pass No. 1 in the forward direction in which the nozzle row for black ink and the nozzle row for chromatic ink are used together, and pass No. 2 in the reverse direction in which only the nozzle row for chromatic ink is used, form an image having a predetermined width (i.e., a width corresponding to the length of each nozzle row) along the sub-scan direction ("unit band" hereafter). A pass in which both a nozzle row for black ink and a nozzle row for chromatic ink are used will hereafter also be referred to as a "combined black-and-chromatic pass", a pass in which a nozzle row for chromatic ink is used will also be referred to as a "chromatic-only pass", and a pass in which a nozzle row for black ink is used will also be referred to as a "black-only pass". Next, pass No. 3, which is a combined black-and-chromatic pass in the forward direction, and pass No. 4, which is a chromatic-only pass in the reverse direction, form the next unit band adjacent to the unit band formed by pass No. 1 and pass No. 2. Thus, in the color region, a recording method is used in which a pass in the forward direction and a pass in the reverse direction are alternated with each other, wherein an image-forming operation comprising a total of two passes derived from one combined black-and-chromatic pass in a predetermined direction (e.g., the forward direction) and one chromatic-only pass in an opposite direction to the predetermined direction (e.g., the reverse direction) form a unit band. Specifically, in the color region, the direction of passes in which a nozzle row for black ink is used is always in the same direction (i.e., the predetermined direction). As described further below, a conveying operation (i.e., paper feeding) corresponding to one main scan line is performed between two passes for forming a unit band.

Also, as shown as pass No. 5 and pass No. 6 in FIG. 4, in the present example, the recording method for a color region as described above is used in an instance in which a part of the unit band to be formed is located in the color region and a remaining part is positioned in a monochrome region, in addition to an instance in which the unit band to be formed is entirely positioned in the color region. In such an instance, of the nozzles forming the nozzle row for chromatic ink, those that are positioned in the monochrome region are masked and are not used. In an instance in which the unit band to be formed is entirely positioned in a monochrome region, a recording method for a monochrome region described as follows is used.

In the first monochrome region in the example shown in FIG. 4, first, pass No. 7, which is a black-only pass in the forward direction, forms a unit band. Next, pass No. 8, which is a black-only pass in the reverse direction, forms the next unit band adjacent to the unit band formed by pass No. 7. Thus, in the monochrome region, a recording method is used in which a black-only pass in the forward direction and a black-only pass in the reverse direction are alternated with each other, wherein an image-forming operation comprising one black-only pass forms a unit band. In subsequent passes Nos. 9 and 10, a part of a unit band to be formed is positioned in a color region; therefore, printing is performed according to the recording method for a color region as described above.

Figure 5:
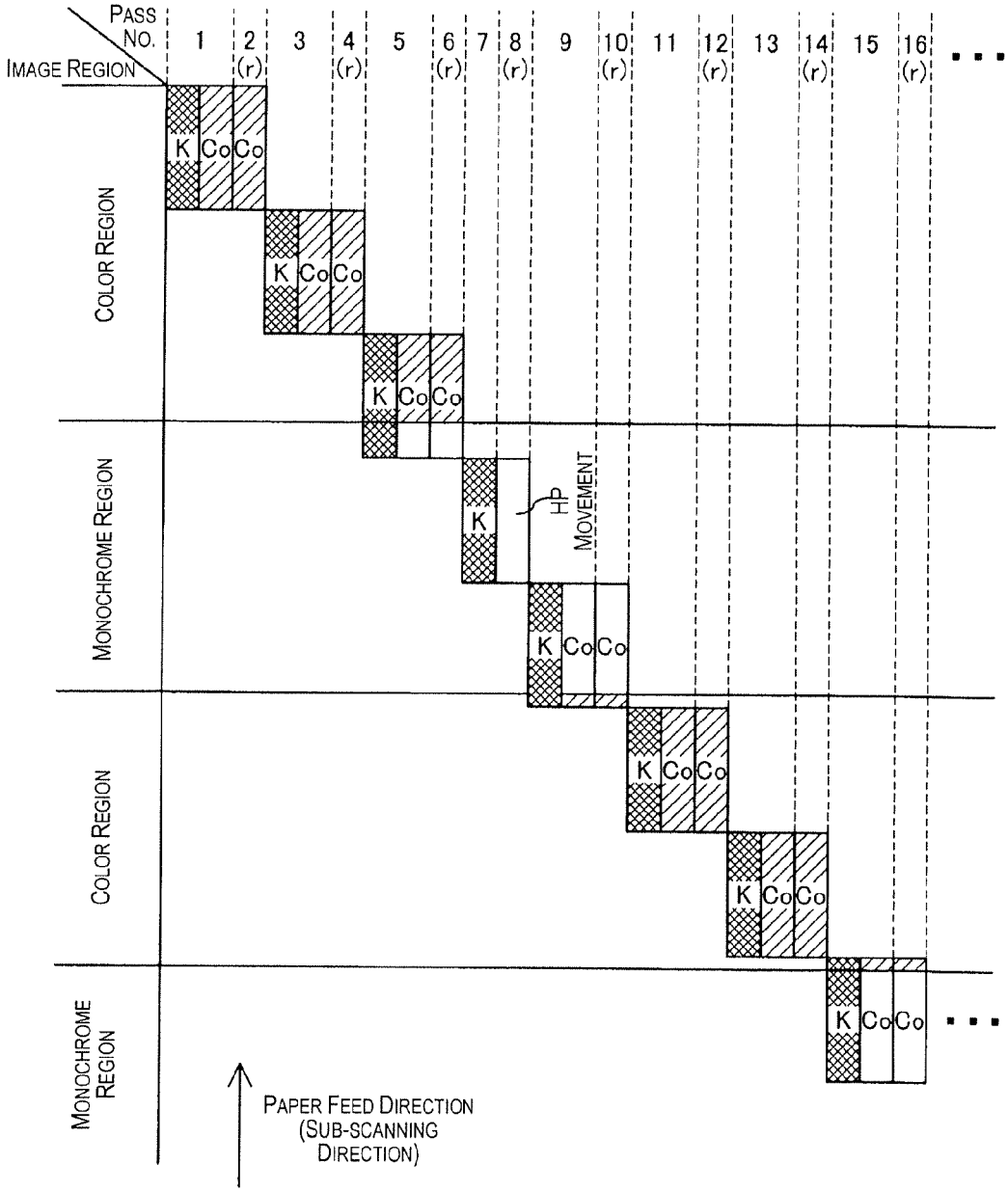
FIG. 5 is a descriptive drawing showing another example of the recording method in print processing performed by the ink-jet printer 20 according to the first example.

FIG. 5 is a descriptive drawing showing another example of print processing by the ink-jet printer 20 according to the first example. In the example shown in FIG. 5, the recording method from pass No. 1 to pass No. 7 is the same as that in the example shown in FIG. 4. In the example shown in FIG. 5, when pass No. 7 in the forward direction is complete, a part of a unit band to be formed in the following pass No. 8 in the reverse direction is positioned in a color region. Therefore, according to the recording method for a color region as described above, the following pass No. 8 is a combined black-and-chromatic pass. However, in the present example, in an instance in which a unit band that is positioned in a monochrome region and is positioned immediately before a boundary with a color region is formed by a pass in the same direction as the predetermined direction during formation of other color regions (i.e., the direction of a combined black-and-chromatic pass), a pass that immediately follows the pass for forming the unit band that is positioned immediately before the boundary is an empty pass, in which neither the nozzle row for black ink nor the nozzle row for chromatic ink is used, in the direction opposite the predetermined direction; and further subsequent passes form the color region. In the example shown in FIG. 5, pass No. 7, which is a pass in the same direction as the predetermined direction in the initial color region (i.e., the forward direction), forms a unit band that is positioned in a monochrome region and is positioned immediately before the color region. Therefore, the following pass No. 8 is an empty pass in the direction opposite the predetermined direction (i.e., the reverse direction), and the following pass No. 9 is a combined black-and-chromatic pass in the same direction as the predetermined direction. Thus, the direction of combined black-and-chromatic passes is the same in all color regions in the printed image.

Figure 6:
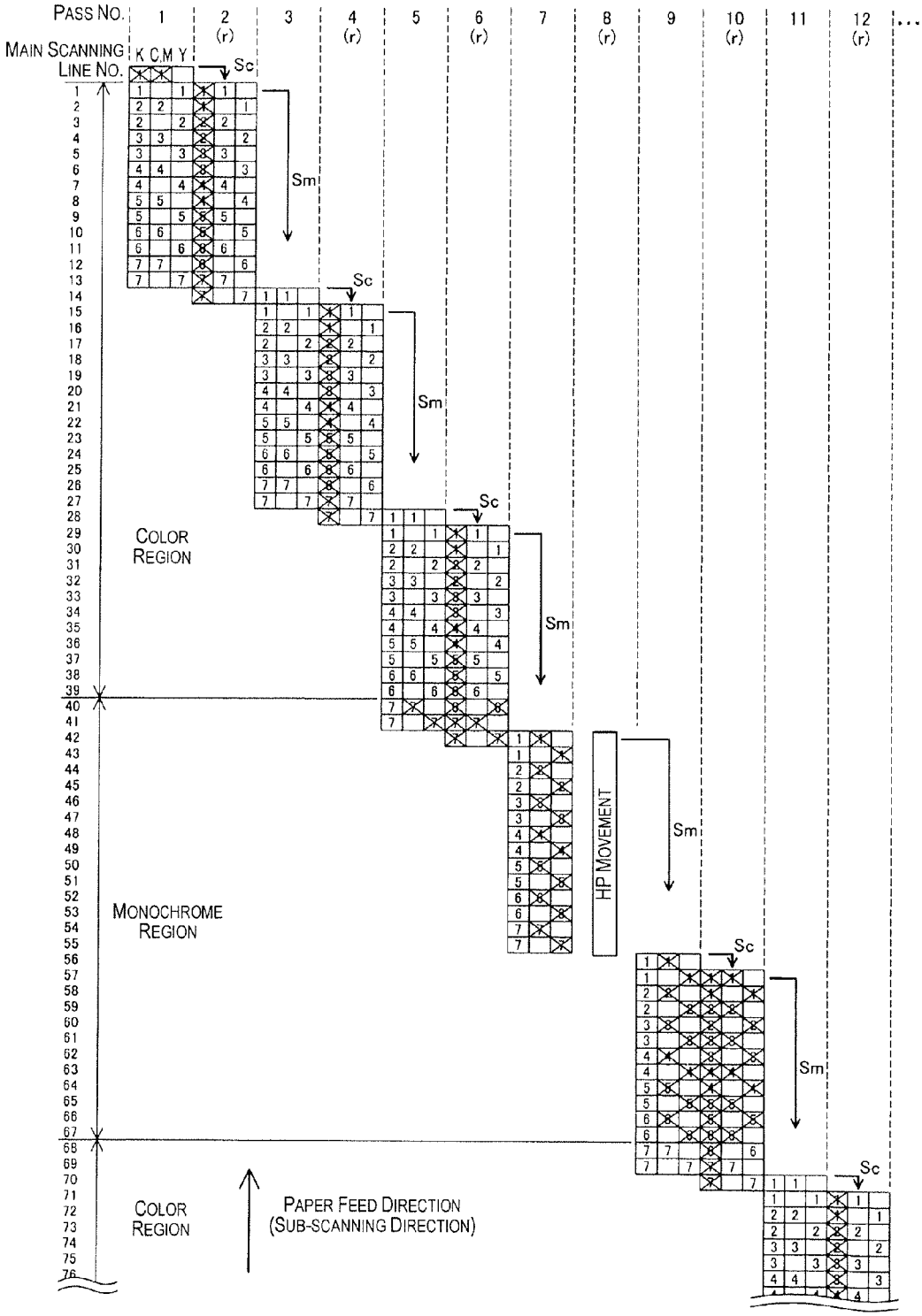
FIG. 6 is a descriptive drawing showing a detailed example of the recording method in print processing performed by the ink-jet printer 20 according to the first example.

FIG. 6 is a descriptive drawing showing a detailed example of a recording method in print processing performed by the ink-jet printer 20 according to the first example. As with FIGS. 4 and 5, FIG. 6 shows positions along the sub-scan direction of a nozzle row used during each pass for forming each of the image regions (i.e., the color regions and the monochrome regions) of the printed image. In FIG. 6, a position of each of the nozzles forming each of the nozzle rows is indicated by a numeral. Since the position along the sub-scan direction of the nozzle row for cyan ink (C) and that of the nozzle row for magenta ink (M) are identical, only the position of one out of the nozzle row for cyan ink and the nozzle row for magenta ink is shown in FIG. 6. A nozzle marked with a cross on top of the numeral representing nozzle position represents a nozzle that is not used in the corresponding pass.

In order to keep the description simple, in the example shown in FIG. 6, each of the nozzle rows for chromatic ink comprises 7 nozzles, and the nozzle row for black ink comprises 14 nozzles. Specifically, if K represents the number of nozzles forming each of the nozzle rows for chromatic ink, the number of nozzles forming the nozzle row for black ink is (n·K), where n=2. Also, in the example shown in FIG. 6, a region of the printed image from a first main scan line (i.e., first line in a raster scan) to a $39^{th}$ main scan line is a color region, a region from a $40^{th}$ main scan line to a $67^{th}$ main scan line is a monochrome region, and a region from a $68^{th}$ main scan onwards is a color region.

As shown in FIG. 6, in a first color region, a combined black-and-chromatic pass in the forward direction is performed as pass No. 1; and a fine conveyance operation Sc corresponding to one main scan line is performed. Then, a chromatic-only pass in the reverse direction is performed as pass No. 2. During pass No. 2, a chromatic color raster is newly formed between chromatic color rasters formed during pass No. 1. Therefore, pass No. 1 and pass No. 2 complete formation of a first unit band. Next, a main conveyance operation Sm corresponding to 13 main scan lines is performed, a combined black-and-chromatic pass in the forward direction is performed as pass No. 3, and a fine conveyance operation Sc corresponding to one main scan line is performed. Then, a chromatic-only pass in the reverse direction is performed as pass No. 4, and the two passes complete formation of a next unit band.

In passes No. 5 and 6 that follow, a part of the unit band to be formed is positioned in a color region and a remaining part is positioned in a monochrome region. Therefore, a similar recording method for a color region is used to form a unit band. Here, of the nozzles forming the nozzle row for chromatic ink, those that are positioned in the monochrome region are masked and are not used.

Also, in the first monochrome region, a black-only pass in the forward direction is performed as pass No. 7. This one pass completes formation of a first unit band in the monochrome region. In the example shown in FIG. 6, when a main conveyance operation Sm corresponding to 13 main scan lines is performed after pass No. 7, a part of a unit band to be formed in the following pass is positioned in a color region. Therefore, in the example shown in FIG. 6, a unit band positioned in a monochrome region and positioned immediately before a boundary with a color region is formed by a pass in the same direction as the predetermined direction during formation of other color regions (i.e., the direction of combined black-and-chromatic passes). Therefore, the following pass No. 8 is an empty pass in the reverse direction in which none of the nozzle rows are used. A main conveyance operation Sm corresponding to 13 main scan lines is then performed. Then, pass No. 9 and subsequent passes form a second color region. In the example shown in FIG. 6, a main conveyance operation Sm is performed after pass No. 8, which is an empty pass. However, the main conveyance operation Sm may be performed after pass No. 7, after which pass No. 8, which is an empty pass, is performed.

As described above, in the ink-jet printer 20 according to the present example, if K represents the number of nozzles forming each of the nozzle rows for chromatic ink, the number of nozzles forming the nozzle row for black ink is (n·K), where n=2. In print processing using the ink-jet printer 20 according to the present example, in a color region, a recording method is used in which a pass in the forward direction and a pass in the reverse direction are alternated with each other, wherein an image-forming operation comprising a total of two passes derived from one combined black-and-chromatic pass in a predetermined direction (e.g., the forward direction) and one chromatic-only pass in an opposite direction to the predetermined direction (e.g., the reverse direction) form a unit band. Specifically, in each of the color regions, the direction of passes in which a nozzle row for black ink is used is always in the same direction (i.e., the predetermined direction). In an instance in which a given color region contains passes in which the nozzle row for black ink is used in both the forward direction and the reverse direction, there is a risk of a positional displacement, along the main scan direction, of a ruled line formed using black ink so as to be substantially parallel to the sub-scan direction (i.e., bi-directional displacement). In the present example, in each of the color regions, the direction of passes in which the nozzle row for black ink is used is always in the same direction. Therefore, it is possible to inhibit occurrence of the positional displacement of the ruled line, and to improve print image quality. In the present example, the number of nozzles forming the nozzle row for black ink is twice the number of nozzles forming each of the nozzle rows for chromatic ink, and a unit band is formed in a color region using one combined black-and-chromatic pass and one chromatic-only pass. Therefore, it is possible to inhibit occurrence of the positional displacement of the ruled line while inhibiting any decrease in printing speed. Also, in the present example, in a monochrome region, a recording method is used in which a black-only pass in the forward direction and a black-only pass in the reverse direction are alternated with each other, wherein one black-only pass forms a unit band. Therefore, it is also possible to increase printing speed in a monochrome region. Also, in a monochrome region, no chromatic color ink is discharged. Therefore, compared to a color region, the amount of ink per unit area on the print medium is relatively smaller, and the deflection of the print medium is smaller. Therefore, in a monochrome region, even if a black-only pass in the forward direction and a black-only pass in the reverse direction are used in combination, there is little risk of occurrence of the positional displacement of the ruled line. For the reasons described above, in the ink-jet printer 20 according to the present example, it is possible to improve print image quality while inhibiting an increase in time required for print processing.

In the ink-jet printer 20 according to the present example, in an instance in which a unit band positioned in a monochrome region and positioned immediately before a boundary with a color region is formed by a pass in the same direction as the predetermined direction during formation of other color regions (i.e., the direction of combined black-and-chromatic passes), a pass that immediately follows a pass for forming the unit band immediately before the boundary is an empty pass in which neither the nozzle row for black ink nor the nozzle row for chromatic ink is used, and further subsequent passes form the color region.

Therefore, in the present example, in all color regions in the printed image, the direction of combined black-and-chromatic passes is always in the same direction. In a combined black-and-chromatic pass in the forward direction, the sequence in which a black ink dot and a chromatic color dot overlap each other is opposite to the sequence in a combined black-and-chromatic pass in the reverse direction. Therefore, in an instance in which the printed image contains an image region formed by a combined black-and-chromatic pass in the forward direction in combination with an image region formed by a combined black-and-chromatic pass in the reverse direction, there is a risk of color unevenness occurring. In the present example, the direction of combined black-and-chromatic passes is always in the same direction in all color regions of the printed image, therefore making it possible to inhibit occurrence of color unevenness, and to further improve print image quality.

B: SECOND EXAMPLE

Figure 7:
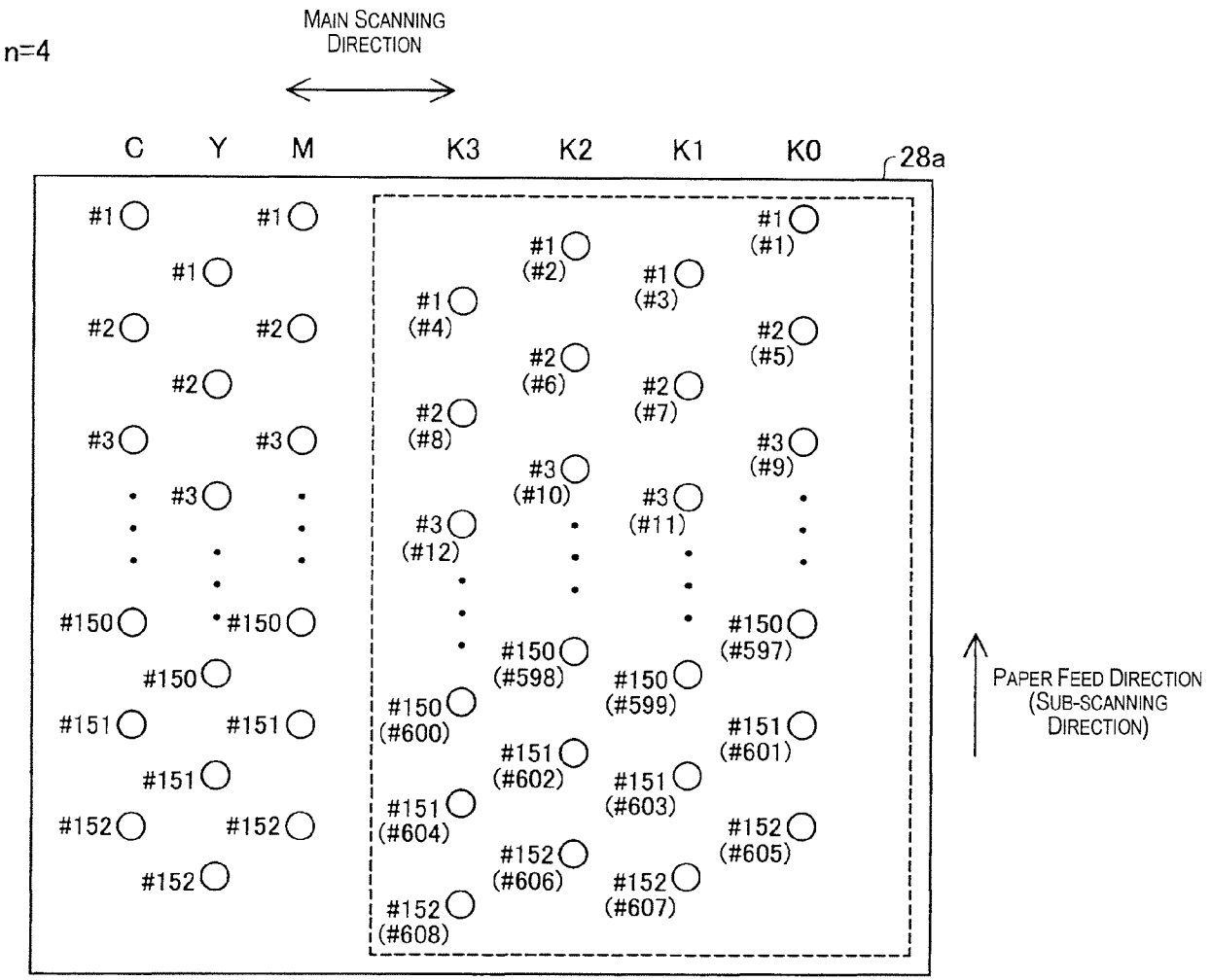
FIG. 7 is a descriptive drawing showing a layout of nozzles provided to a printing head **28*a* of the ink-jet printer 20** according to a second example.

FIG. 7 is a descriptive drawing showing a layout of nozzles provided to a printing head 28*a* of the ink jet printer 20 according to a second example. The layout of nozzles in the printing head 28*a* according to the second example is different from the layout of nozzles in the first example shown in FIG. 3 in that, for black ink, four nozzles rows, each comprising 152 nozzles, are arranged. Specifically, the printing head 28*a* according to the second example is provided with a nozzle row K2 for black ink and a nozzle row K3 for black ink in addition to the nozzle rows K0, K1 for black ink.

As shown in FIG. 7, the nozzle row K2 for black ink and the nozzle row K3 for black ink have the same nozzle pitch as that of the nozzle row K0 for black ink and the nozzle row K1 for black ink. With regards to positions along the sub-scan direction, the position of the nozzle row K2 for black ink is displaced relative to the position of the nozzle row K0 for black ink by one quarter of the nozzle pitch, and the position of the nozzle row K3 for black ink is displaced relative to the position of the nozzle row K1 for black ink by one quarter of the nozzle pitch. Therefore, the four nozzle rows K0, K2, K1, K3 for black ink are sequentially arranged so as to be respectively displaced by one quarter of the nozzle pitch relative to each other. The four nozzle rows for black ink can also be interpreted as one nozzle row comprising 608 nozzles, as indicated by nozzle numbers in parentheses in FIG. 7. According to this interpretation, if K represents the number of nozzles forming each of the nozzle rows for chromatic ink, the number of nozzles forming the nozzle row for black ink is (n·K), where n=4. In other words, the number of nozzles forming the nozzle row for black ink is four times greater than that of nozzles forming the nozzle row for chromatic ink. Also, the nozzle pitch of the nozzle row for black ink is four times as fine as the nozzle pitch of each of the nozzle rows for chromatic ink.

Figure 8:
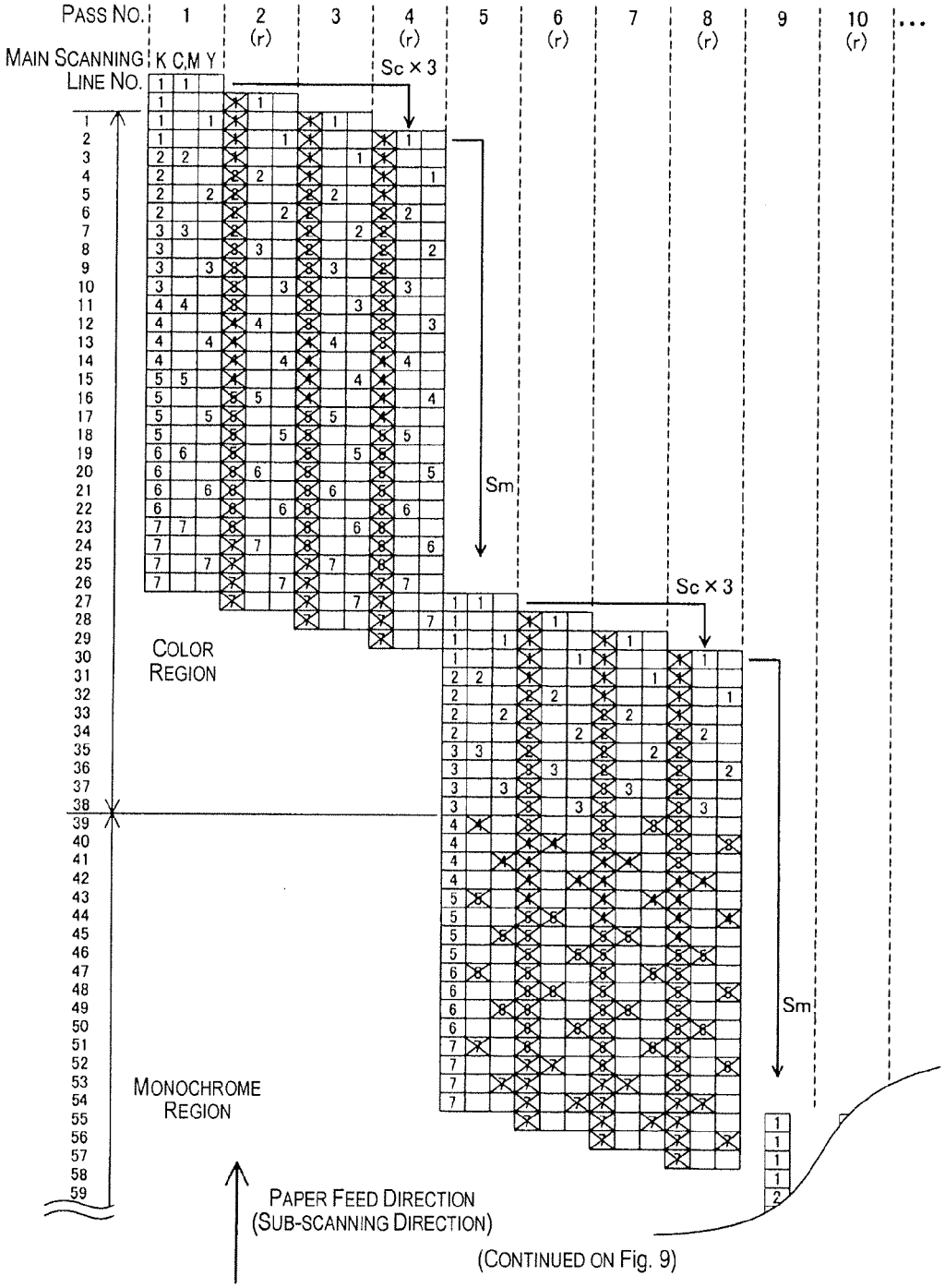
FIG. 8 is a descriptive drawing showing an example of a recording method in print processing performed by the ink-jet printer 20 according to the second example.
Figure 9:
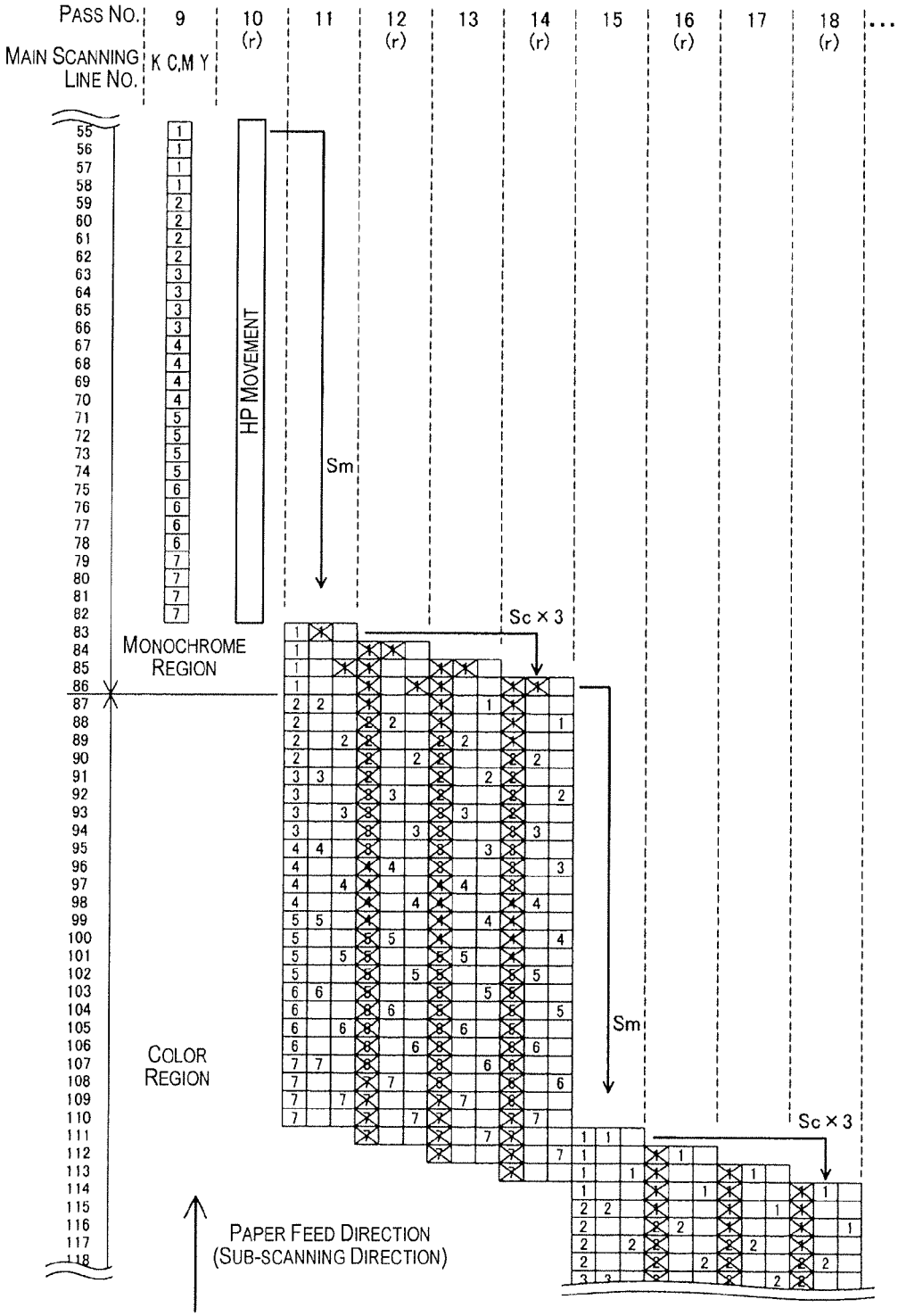
FIG. 9 is a descriptive drawing showing the example of the recording method in print processing performed by the ink jet printer 20 according to the second example.

FIGS. 8 and 9 are descriptive drawings showing an example of a recording method in print processing performed by the ink-jet printer 20 according to the second example. As with FIG. 6 showing the recording method according to the first example, FIGS. 8 and 9 show positions along the sub-scan direction of a nozzle row used during each pass for forming each of the image regions (i.e., the color regions and the monochrome regions) of the printed image.

In order to keep the description simple, in the example shown in FIGS. 8 and 9, each of the nozzle rows for chromatic ink comprise 7 nozzles, and the nozzle row for black ink comprises 28 nozzles. In other words, if K represents the number of nozzles forming each of the nozzle rows for chromatic ink, the number of nozzles forming the nozzle row for black ink is (n·K), where n=4. Also, in the example shown in FIGS. 8 and 9, a region of the printed image from a first main scan line (i.e., first raster) to a $38^{th}$ main scan line is a color region, a region from a $39^{th}$ main scan line to an $86^{th}$ main scan line is a monochrome region, and a region from an $87^{th}$ main scan onwards is a color region.

As shown in FIG. 8, in a first color region, a combined black-and-chromatic pass in the forward direction is performed as pass No. 1; and a fine conveyance operation Sc corresponding to one main scan line is performed. Then, a chromatic-only pass in the reverse direction is performed as pass No. 2. Then, a fine conveyance operation Sc corresponding to one main scan line is performed, followed by a chromatic-only pass in the forward direction performed as pass No. 3. A fine conveyance operation Sc corresponding to one main scan line is performed, followed by a chromatic-only pass in the reverse direction performed as pass No. 4. During each of the passes No. 2 to 4, a chromatic color raster is newly formed between chromatic color rasters formed during pass No. 1. The four passes from pass No. 1 to No. 4 complete formation of a first unit band.

Next, a main conveyance operation Sm corresponding to 25 main scan lines is performed, a combined black-and-chromatic pass in the forward direction is performed as pass No. 5, and a fine conveyance operation Sc corresponding to one main scan line is performed. Then, a chromatic-only pass in the reverse direction is performed as pass No. 6, a fine conveyance operation Sc corresponding to one main scan line is performed, a chromatic-only pass in the forward direction is performed as pass No. 7, and a fine conveyance operation Sc corresponding to one main scan line is performed. Then, a chromatic-only pass in the reverse direction is performed as pass No. 8. The four passes from pass No. 5 to 8 complete formation of a next unit band. Since a part of the unit band formed here is positioned in a monochrome region, in each of the passes, nozzles that are positioned in the monochrome region are masked and are not used.

Thus, in a color region, a recording method is used in which a pass in the forward direction and a pass in the reverse direction are alternated with each other, wherein an image-forming operation comprising a total of four passes derived from one combined black-and-chromatic pass in a predetermined direction (e.g., the forward direction) and three chromatic-only passes in either the forward direction or the reverse direction form a unit band. Specifically, in a color region, the direction of all passes in which the nozzle row for black ink is used is always the same direction (i.e., the predetermined direction). In the present example, of the four passes performed in order to form a unit band in the color region, the first pass in the predetermined direction is a combined black-and-chromatic pass. For example, in an instance in which the predetermined direction is the forward direction, of passes No. 1 through 4 performed in order to form the first unit band, pass No. 1, which is the first pass in the predetermined direction, rather than pass No. 3, which is the second pass in the predetermined direction, is a combined black-and-chromatic pass.

Also, in the first monochrome region, a black-only pass in the forward direction is performed as pass No. 9 (see FIG. 9). This one pass completes formation of a first unit band in the monochrome region. In the second example, in the monochrome region, a recording method is again used in which a black-only pass in the forward direction and a black-only pass in the reverse direction are alternated with each other, wherein an image-forming operation comprising one black-only pass forms a unit band.

In the second example, as with the first example, in an instance in which a unit band positioned in a monochrome region and positioned immediately before a boundary with a color region is formed by a pass in the same direction as the predetermined direction during formation of other color regions (i.e., the direction of combined black-and-chromatic passes), a pass that immediately follows a pass for forming the unit band immediately before the boundary is an empty pass in which neither the nozzle row for black ink nor the nozzle row for chromatic ink is used, and further subsequent passes form the color region. In the example shown in FIG. 9, when a main conveyance operation Sm corresponding to 25 main scan lines is performed after pass No. 9, a part of a unit band to be formed in the following pass is positioned in a color region. Therefore, a unit band positioned in a monochrome region and positioned immediately before a boundary with a color region is formed by a pass in the same direction as the predetermined direction during formation of other color regions (i.e., the direction of combined black-and-chromatic passes). Therefore, the following pass No. 10 is an empty pass in the reverse direction which none of the nozzle rows are used. A main conveyance operation Sm corresponding to 25 main scan lines is then performed. Then, pass No. 11 and subsequent passes form a second color region. In the example shown in FIG. 9, a main conveyance operation Sm is performed after pass No. 9, which is an empty pass. However, the main conveyance operation Sm may be performed after pass No. 9, after which pass No. 10, which is an empty pass, is performed.

As described above, in the ink jet printer 20 according to the second example, if K represents the number of nozzles forming each of the nozzle rows for chromatic ink, the number of nozzles forming the nozzle row for black ink is (n·K), where n=4. In print processing using the ink-jet printer 20 according to the present example, in a color region, a recording method is used in which a pass in the forward direction and a pass in the reverse direction are alternated with each other, wherein an image-forming operation comprising a total of four passes derived from one combined black-and-chromatic pass in a predetermined direction (e.g., the forward direction) and three chromatic-only passes in either the forward direction or the reverse direction form a unit band. Specifically, in each of the color regions, the direction of passes in which a nozzle row for black ink is used is always in the same direction (i.e., the predetermined direction). Therefore, as with the first example, it is possible in the second example to inhibit occurrence of the positional displacement of the ruled line, and to improve print image quality. In the second example, the number of nozzles forming the nozzle row for black ink is four times greater than the number of nozzles forming each of the nozzle rows for chromatic ink, and a unit band is formed in a color region using one combined black-and-chromatic pass and three chromatic-only passes. Therefore, it is possible to inhibit occurrence of positional displacement of a ruled line while inhibiting any decrease in printing speed. Also, in the second example, in a monochrome region, a recording method is used in which a black-only pass in the forward direction and a black-only pass in the reverse direction are alternated with each other, wherein one black-only pass forms a unit band. Therefore, it is possible to increase printing speed in a monochrome region where the amount of ink per unit area is relatively small and there is less risk of occurrence of a positional displacement of a ruled line. Therefore, as with the first example, it is again possible in the ink-jet printer 20 according to the second example to improve print image quality while inhibiting an increase in time required for print processing.

Also, as with the first example, in the ink-jet printer 20 according to the second example, in an instance in which a unit band positioned in a monochrome region and positioned immediately before a boundary with a color region is formed by a pass in the same direction as the predetermined direction during formation of other color regions (i.e., the direction of combined black-and-chromatic passes), a pass that immediately follows a pass for forming the unit band immediately before the boundary is an empty pass in which neither the nozzle row for black ink nor the nozzle row for chromatic ink is used, and further subsequent passes form the color region.

Also, in the ink-jet printer 20 according to the second example, of the four passes performed in order to form a unit band in a color region, the first pass in the predetermined direction (e.g., the forward direction) is a combined black-and-chromatic pass. In an instance in which the unit band is formed using a plurality of passes, the amount of ink in the region on the print medium corresponding to the unit band increases with each pass, and print medium deflection in the unit band therefore increases. In the second example, since the first pass in the predetermined direction is a combined black-and-chromatic pass, the nozzle row for black ink is used while the deflection of the print medium is relatively small, and it is possible to inhibit occurrence of a positional displacement of a ruled line in an effective manner.

C. THIRD EXAMPLE

Figure 10:
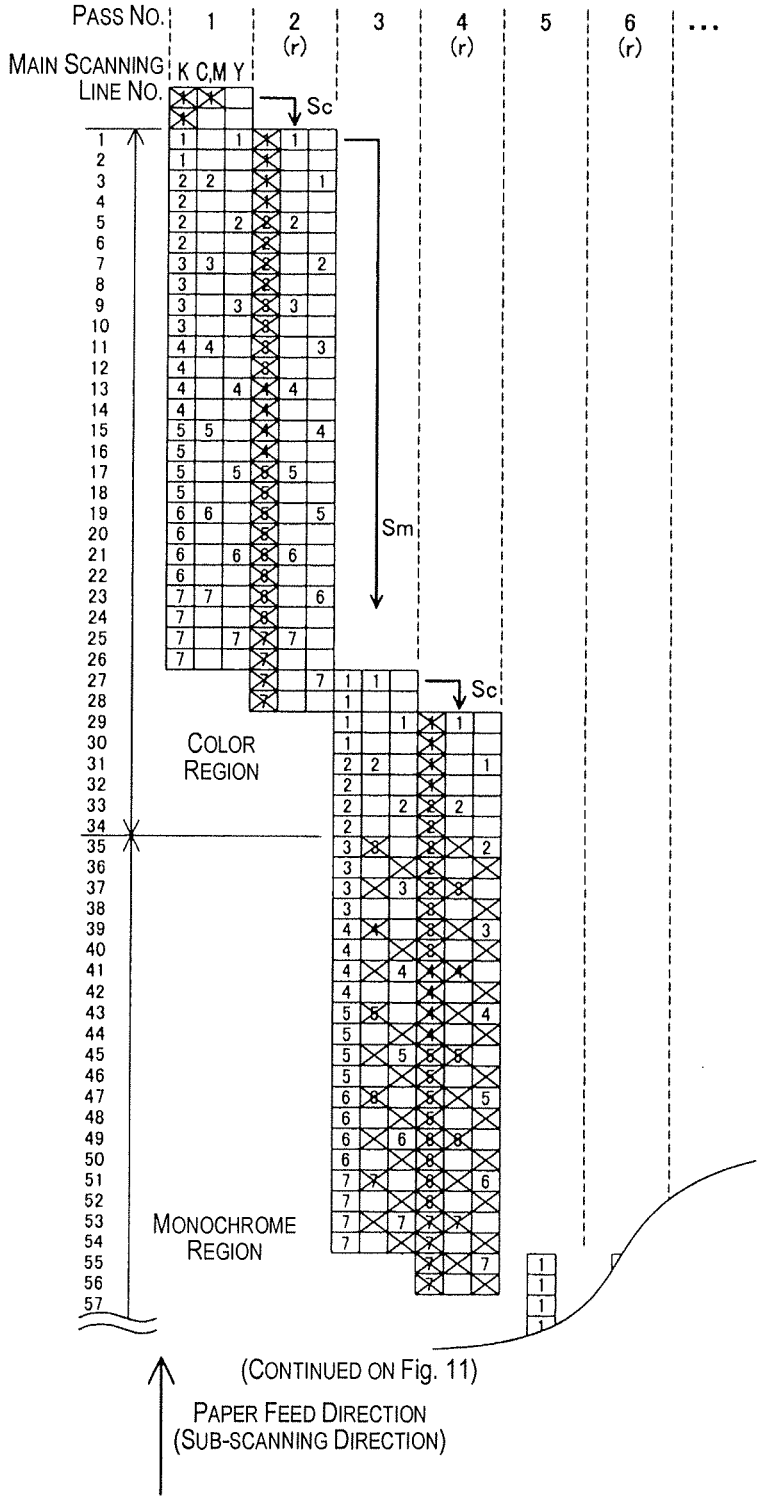
FIG. 10 is a descriptive drawing showing an example of a recording method in print processing performed by the ink-jet printer 20 according to a third example.
Figure 11:
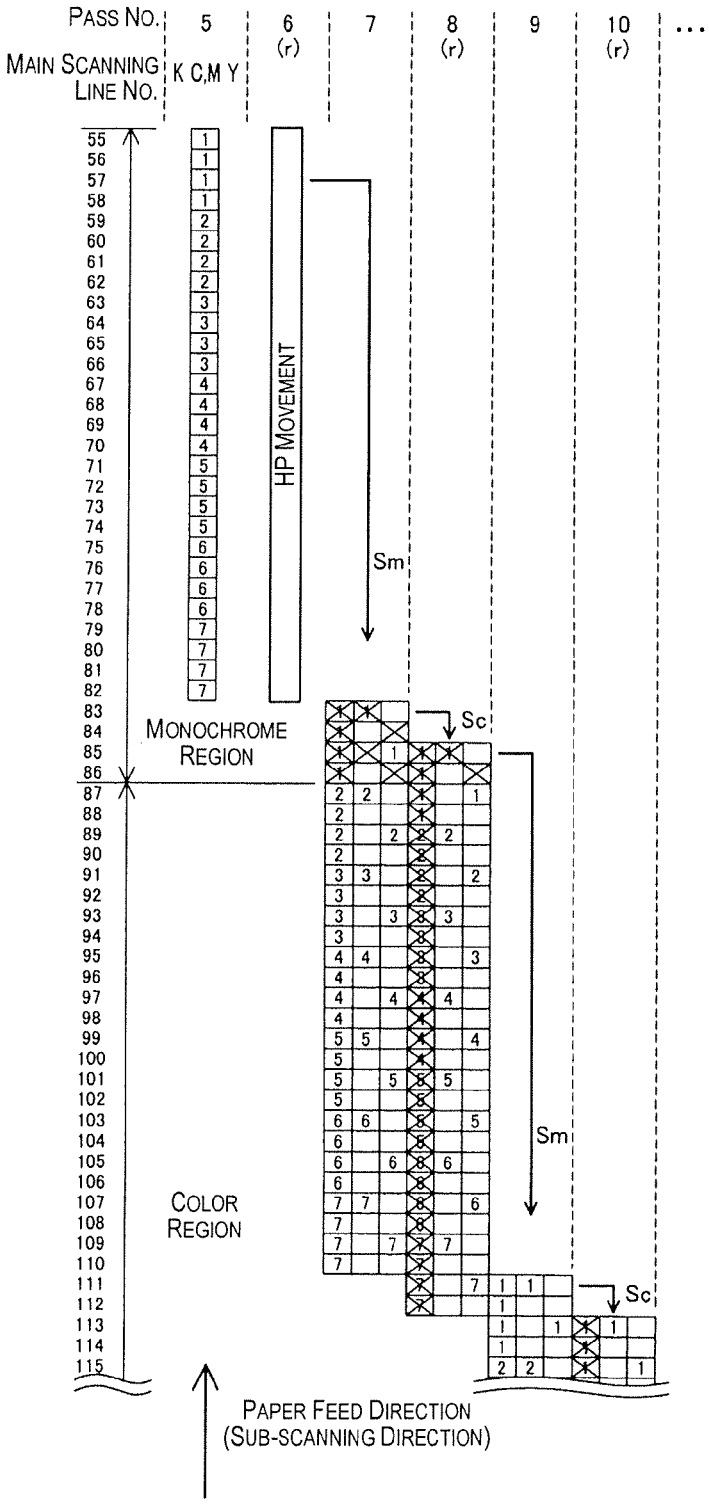
FIG. 11 is a descriptive drawing showing the example of a recording method in print processing performed by the ink-jet printer 20 according to the third example.

FIGS. 10 and 11 are descriptive drawings showing an example of a recording method in print processing performed by the ink-jet printer 20 according to a third example. As with FIG. 6 showing a recording method according to the first example, FIGS. 10 and 11 show positions along the sub-scan direction of a nozzle row used during each pass for forming each of the image regions (i.e., the color regions and the monochrome regions) of the printed image.

In the example shown in FIGS. 10 and 11, each of the nozzle rows for chromatic ink comprise 7 nozzles, and the nozzle row for black ink comprises 28 nozzles. In other words, if K represents the number of nozzles forming each of the nozzle rows for chromatic ink, the number of nozzles forming the nozzle row for black ink is (n·K), where n=4. Also, in the example shown in FIGS. 10 and 11, a region of the printed image from a first main scan line (i.e., first raster) to a $34^{th}$ main scan line is a color region, a region from a $35^{th}$ main scan line to an $86^{th}$ main scan line is a monochrome region, and a region from an $87^{th}$ main scan onwards is a color region.

As shown in FIG. 10, in a first color region, a combined black-and-chromatic pass in the forward direction is performed as pass No. 1; and a fine conveyance operation Sc corresponding to two main scan lines is performed. Then, a chromatic-only pass in the reverse direction is performed as pass No. 2. In the second pass, a chromatic color raster is newly formed between chromatic color rasters formed during pass No. 1. The two passes, comprising pass No. 1 and pass No. 2, complete formation of the first unit band. In the unit band formed here, the resolution along the sub-scan direction of a main scan line formed by the nozzle row for black ink is twice the resolution along the sub-scan direction of a main scan line formed by a nozzle row for chromatic ink.

Next, a main conveyance operation Sm corresponding to 26 main scan lines is performed, a combined black-and-chromatic pass in the forward direction is performed as pass No. 3, and a fine conveyance operation Sc corresponding to two main scan lines is performed. Then, a chromatic-only pass in the reverse direction is performed as pass No. 4. The two passes, comprising pass No. 3 and pass No. 4, complete formation of a next unit band. Since a part of the unit band formed here is positioned in a monochrome region, in each of the passes, nozzles that are positioned in the monochrome region are masked and are not used.

Thus, in a color region, a recording method is used in which a pass in the forward direction and a pass in the reverse direction are alternated with each other, wherein an image-forming operation comprising a total of two passes derived from one combined black-and-chromatic pass in a predetermined direction (e.g., the forward direction) and one chromatic-only pass in the direction opposite the predetermined direction (e.g., the reverse direction) form a unit band. Specifically, in a color region, the direction of all passes in which the nozzle row for black ink is used is always the same direction (i.e., the predetermined direction).

Also, in the first monochrome region, a black-only pass in the forward direction is performed as pass No. 5 (see FIG. 11). This one pass completes formation of a first unit band in the monochrome region. In the third example, in the monochrome region, a recording method is again used in which a black-only pass in the forward direction and a black-only pass in the reverse direction are alternated with each other, wherein an image-forming operation comprising one black-only pass forms a unit band.

In the third example, as with previous examples, in an instance in which a unit band positioned in a monochrome region and positioned immediately before a boundary with a color region is formed by a pass in the same direction as the predetermined direction during formation of other color regions (i.e., the direction of combined black-and-chromatic passes), a pass that immediately follows a pass for forming the unit band immediately before the boundary is an empty pass in which neither the nozzle row for black ink nor the nozzle row for chromatic ink is used, and further subsequent passes form the color region. In the example shown in FIG. 11, when a main conveyance operation Sm corresponding to 26 main scan lines is performed after pass No. 5, a part of a unit band to be formed in the following pass is positioned in a color region. Therefore, a unit band positioned in a monochrome region and positioned immediately before a boundary with a color region is formed by a pass in the same direction as the predetermined direction during formation of other color regions (i.e., the direction of combined black-and-chromatic passes). Therefore, the following pass No. 6 is an empty pass in the reverse direction which none of the nozzle rows are used. A main conveyance operation Sm corresponding to 26 main scan lines is then performed. Then, pass No. 7 and subsequent passes form a second color region. In the example shown in FIG. 11, a main conveyance operation Sm is performed after pass No. 6, which is an empty pass. However, the main conveyance operation Sm may be performed after pass No. 5, after which pass No. 6, which is an empty pass, is performed.

As described above, in the ink-jet printer 20 according to the third example, if K represents the number of nozzles forming each of the nozzle rows for chromatic ink, the number of nozzles forming the nozzle row for black ink is (n·K), where n=4. In print processing using the ink-jet printer 20 according to the third example, a recording method is used in which, in a color region, a pass in the forward direction and a pass in the reverse direction are alternated with each other, wherein an image-forming operation comprising a total of two passes derived from one combined black-and-chromatic pass in a predetermined direction (e.g., the forward direction) and one chromatic-only pass in an opposite direction to the predetermined direction (e.g., the reverse direction) form a unit band. Specifically, in each of the color regions, the direction of passes in which a nozzle row for black ink is used is always in the same direction (i.e., the predetermined direction). Therefore, as with the first example, it is possible in the third example to inhibit occurrence of the positional displacement of the ruled line, and to improve print image quality. In the third example, the number of nozzles forming the nozzle row for black ink is twice the number of nozzles forming each of the nozzle rows for chromatic ink; a unit band is formed in a color region using one combined black-and-chromatic pass and one chromatic-only pass; and the resolution along the sub-scan direction of a main scan line formed by the nozzle row for black ink is twice the resolution along the sub-scan direction of a main scan line formed by the nozzle row for chromatic ink. Therefore, it is possible to inhibit occurrence of positional displacement of a ruled line while inhibiting any decrease in printing speed.

Also, in the third example, in a monochrome region, a recording method is used in which a black-only pass in the forward direction and a black-only pass in the reverse direction are alternated with each other, wherein one black-only pass forms a unit band. Therefore, it is also possible to increase printing speed in a monochrome region where the amount of ink per unit area is relatively small and there is less risk of occurrence of a positional displacement of a ruled line. Therefore, as with the first example, it is again possible in the ink jet printer 20 according to the third example to improve print image quality while inhibiting an increase in time required for print processing.

Also, as with the first example, in the ink jet printer 20 according to the third example, in an instance in which a unit band positioned in a monochrome region and positioned immediately before a boundary with a color region is formed by a pass in the same direction as the predetermined direction during formation of other color regions (i.e., the direction of combined black-and-chromatic passes), a pass that immediately follows a pass for forming the unit band immediately before the boundary is an empty pass in which neither the nozzle row for black ink nor the nozzle row for chromatic ink is used, and further subsequent passes form the color region. Therefore, the direction of combined black-and-chromatic passes is always in the same direction in all color regions of the printed image, and it is possible to inhibit occurrence of color unevenness and to further improve print image quality.

D. FOURTH EXAMPLE

Figure 12:
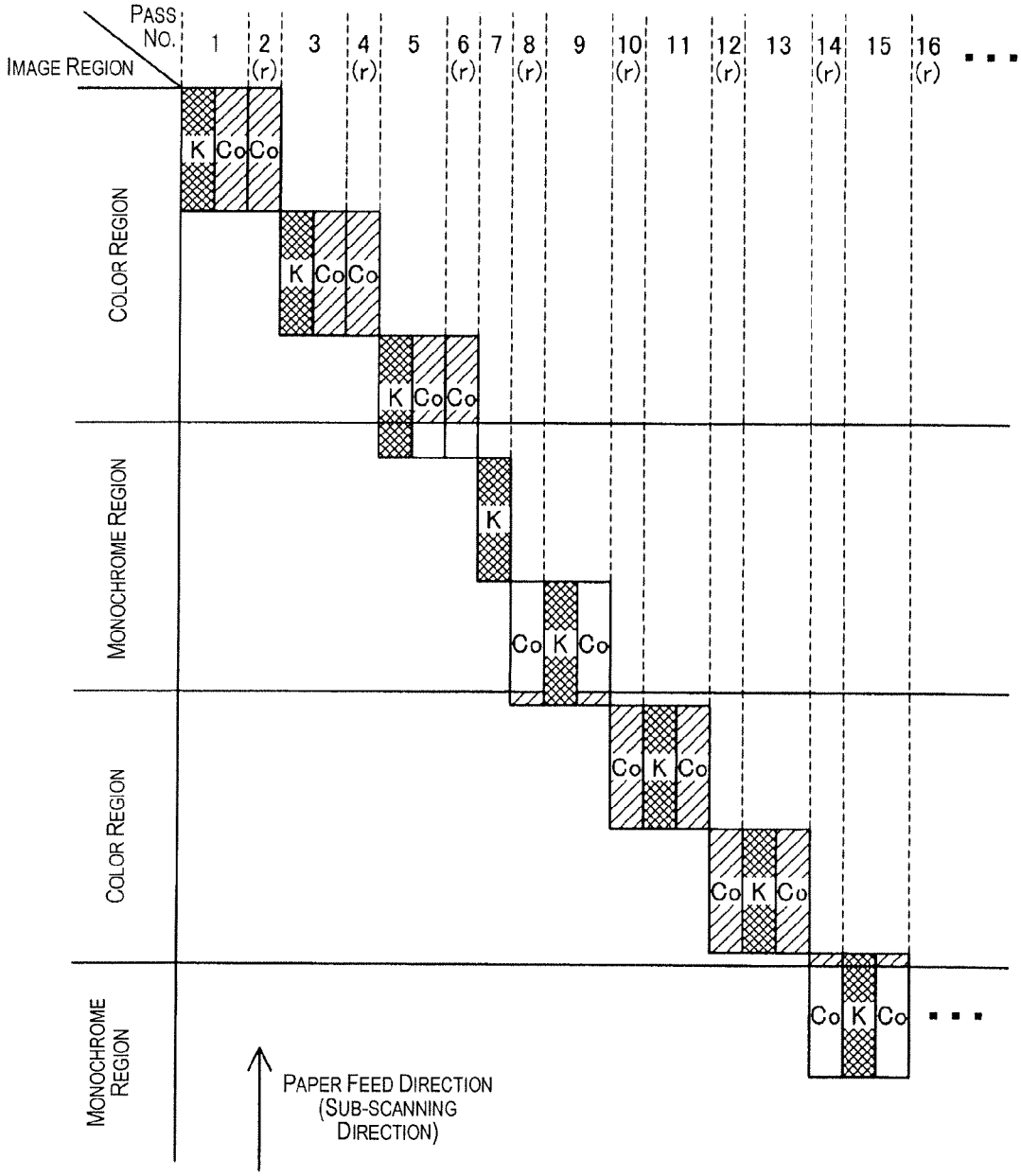
FIG. 12 is a descriptive drawing showing an example of a recording method in print processing performed by the ink-jet printer 20 according to a fourth example.

FIG. 12 is a descriptive drawing showing an example of a recording method in print processing performed by the ink-jet printer 20 according to a fourth example. As with FIG. 4 showing the recording method according to the first example, FIG. 12 shows positions along the sub-scan direction of a nozzle row used during each pass for forming each of the image regions (i.e., the color regions and the monochrome regions) of the printed image. The layout of nozzle rows in the printing head 28 according to the fourth example is the same as that according to the first example shown in FIG. 3. Specifically, the number of nozzles forming the nozzle row for black ink is twice the number of nozzles forming each of the nozzle rows for chromatic ink.

In the example shown in FIG. 12, the recording method from pass No. 1 to pass No. 7 is the same as that in the example of FIG. 4. In the example shown in FIG. 12, when pass No. 7 in the forward direction is complete, a part of a unit band to be formed in the following pass No. 8 is positioned in a color region. Therefore, according to the recording method for a color region, the following pass No. 8 in the reverse direction is a combined black-and-chromatic pass. However, in the fourth example, in an instance in which a unit band that is positioned in a monochrome region and is positioned immediately before a boundary with a color region is formed by a pass in the same direction as the predetermined direction during formation of other color regions (i.e., the direction of the combined black-and-chromatic pass), a pass that immediately follows the pass for forming the unit band immediately before the boundary is a chromatic-only pass in the direction opposite the predetermined direction, and a pass that subsequently follows is a combined black-and-chromatic pass in the predetermined direction. In the example shown in FIG. 12, pass No. 7, which is a pass in the same direction as the predetermined direction in the first color region (i.e., the forward direction), forms the unit band that is positioned in a monochrome region and is positioned immediately before a boundary with a color region. Therefore, the following pass No. 8 is a chromatic-only pass in the direction opposite the predetermined direction (i.e., the reverse direction), and the following pass No. 9 is a combined black-and-chromatic pass in the same direction as the predetermined direction (i.e., the forward direction). Subsequent unit bands in the color region are each formed by one chromatic-only pass in the reverse direction and one subsequent combined black-and-chromatic pass in the forward direction.

As described above, in the ink-jet printer 20 according to the fourth example, if K represents the number of nozzles forming each of the nozzle rows for chromatic ink, the number of nozzles forming the nozzle row for black ink is (n·K), where n=2. In print processing using the ink-jet printer 20 according to the fourth example, in a color region, a recording method is used in which a pass in the forward direction and a pass in the reverse direction are alternated with each other, wherein an image-forming operation comprising a total of two passes derived from one combined black-and-chromatic pass in a predetermined direction (e.g., the forward direction) and one chromatic-only pass in an opposite direction to the predetermined direction (e.g., the reverse direction) form a unit band. Specifically, in each of the color regions, the direction of passes in which a nozzle row for black ink is used is always in the same direction (i.e., the predetermined direction). Therefore, as with the first example, it is possible in the fourth example to inhibit occurrence of the positional displacement of the ruled line, and to improve print image quality.

In the fourth example, the number of nozzles forming the nozzle row for black ink is twice the number of nozzles forming each of the nozzle rows for chromatic ink, and a unit band is formed in a color region using one combined black-and-chromatic pass and one chromatic-only pass. Therefore, it is possible to inhibit occurrence of a positional displacement of a ruled line while inhibiting any decrease in printing speed. Also, in the fourth example, in a monochrome region, a recording method is used in which a black-only pass in the forward direction and a black-only pass in the reverse direction are alternated with each other, wherein one black-only pass forms a unit band. Therefore, it is possible to increase printing speed in a monochrome region where the amount of ink per unit area is relatively small and there is less risk of occurrence of a positional displacement of a ruled line. For the reasons described above, in the ink-jet printer 20 according to the fourth example, as with the first example, it is possible to improve print image quality while inhibiting an increase in time required for print processing.

In the ink-jet printer 20 according to the fourth example, in an instance in which a unit band positioned in a monochrome region and positioned immediately before a boundary with a color region is formed by a pass in the same direction as the predetermined direction during formation of other color regions, a pass that immediately follows a pass for forming the unit band immediately before the boundary is a chromatic-only pass in the direction opposite the predetermined direction, and a pass that subsequently follows is a combined black-and-chromatic pass in the predetermined direction. Therefore, in the fourth example, the direction of combined black-and-chromatic passes is always in the same direction in all color regions of the printed image, and it is possible to inhibit occurrence of color unevenness and to further improve print image quality.

Also, in the fourth example, there are no empty passes in which neither the nozzle row for black ink nor the nozzle row for chromatic ink is used. It is therefore possible to inhibit an increase in time required for print processing in a more effective manner.

E. MODIFICATION EXAMPLES

The present invention is not limited in scope to the examples or the embodiment described above, and may be achieved in a variety of forms that do not depart from the scope of the invention. For example, the following modifications are possible.

E1. MODIFICATION EXAMPLE 1

In each of the examples described above, if K represents the number of nozzles forming each of the nozzle rows for chromatic ink, and the number of nozzles forming the nozzle row for black ink is (n·K), the value of n is 2 or 4. However, n may be another desired value as long as n is an integer equal to or greater than 2. Irrespective of the value of n, the recording method used in a color region may be one in which a pass in the forward direction and a pass in the reverse direction are alternated with each other, wherein an image-forming operation comprising a total of m passes derived from one combined black-and-chromatic pass in the predetermined direction and (m·1) chromatic-only passes in either the forward direction or the reverse direction (where m is an integer equal to or greater than 2 and equal to or less than n) form a unit band, and the recording method used in the monochrome region may be one in which one black-only pass forms a unit band.

In an instance in which the value of n is an even number, the combination of the direction of each of the passes in a sequence for forming each of the unit bands may be made consistent. For example, in an instance in which the value of n is 4 and the recording method used is one in which a total of 4 passes form a unit band, the combination of the direction of each of the passes in a sequence for forming each of the unit band may be made consistent so that, for example, the passes are performed in a sequence of forward direction—reverse direction—forward direction—reverse direction. In contrast, in an instance in which, for example, the value of n is 3 and the recording method used is one in which a total of 3 passes form a unit band, the combination of the direction of each of the passes in a sequence for forming each of the unit band is, e.g., forward direction—reverse direction—forward direction for one unit band, and reverse direction—forward direction—reverse direction for the next unit band. It is thus difficult to make the combination of the direction of each of the passes consistent. If the combination of the direction of each of the passes in a sequence for forming each of the unit bands is not consistent, there is a risk of it becoming necessary to adjust the amount of conveyance in a conveying operation in order to prevent a main scan line (i.e., in raster scanning) from being missed, or the process otherwise becoming complex. Therefore, in terms of the viewpoint of simplifying, and thereby speeding up, the process, it is preferable that n is an even number.

Also, according to each of the examples described above, in a monochrome region, the recording method used is one in which a black-only pass in the forward direction and a black-only pass in the reverse direction are alternated with each other. However, the recording method may be one in which a black-only pass in either one of the forward direction or the reverse direction is repeatedly performed. It thus becomes possible to inhibit occurrence of a positional displacement of a ruled line in a monochrome region in an effective manner, although there is a risk of an increase in the printing time.

E2. MODIFICATION EXAMPLE 2

In each of the examples described above, of a plurality of passes performed in order to form a unit band in a color region, a first pass in the predetermined direction is a combined black-and-chromatic pass. However, the combined black-and-chromatic pass is not necessarily required to be the first pass in the predetermined direction. For example, of pass Nos. 1 through 4 performed in order to form the first unit band in the example shown in FIG. 8, pass No. 3, which is the second pass in the predetermined direction, rather than pass No. 1, which is the first pass in the predetermined direction, may be a combined black-and-chromatic pass. Specifically, of the plurality of passes performed in order to form a unit band, any one of the passes may be a combined black-and-chromatic pass, with the remaining passes being chromatic-only passes, as long as the direction of combined black-and-chromatic passes in a given color region is consistent. However, with each pass, the amount of ink in the region on the print medium corresponding to the unit band increases, and the print medium deflection tends to increase. Therefore, it is more preferable in terms of inhibiting displacement of a ruled line that, of the plurality of passes performed in order to form a unit band, a pass that is performed earlier is a combined black-and-chromatic pass.

E3. MODIFICATION EXAMPLE 3

According to each of the examples described above, in an instance in which a unit band positioned in a monochrome region and positioned immediately before a boundary with a color region is formed by a pass in the same direction as the predetermined direction during formation of other color regions, a pass that immediately follows a pass for forming the unit band immediately before the boundary is, e.g., an empty pass in which neither the nozzle row for black ink nor the nozzle row for chromatic ink is used, and further subsequent passes form the color region, thereby causing the direction of combined black-and-chromatic passes in all color regions in the printed image to be in the same direction, inhibiting occurrence of color unevenness, and further improving print image quality. However, even in such an instance, it is also possible to e.g., not perform an empty pass, wherein a pass immediately following the pass for forming the unit band immediately before the boundary is a pass for forming a color region. Even so, in terms of individual color regions in the printed image, the direction of all passes in which the nozzle row for black ink is used is always in the same direction (i.e., the predetermined direction), and it is therefore possible to inhibit occurrence of a displacement of a ruled line.

E4. MODIFICATION EXAMPLE 4

The configuration of the ink-jet printer 20 in each of the examples described above is a mere example, and may be modified in a variety of ways. For example, in each of the examples described above, the ink-jet printer 20 is a printer in which printing is performed using four colors of ink, i.e., black as an achromatic color and cyan, magenta, and yellow as chromatic colors. However, the ink-jet printer 20 may be a printer in which printing is performed using ink in four or fewer colors or six or more colors as long as both achromatic ink and chromatic ink is used. Regardless of the number of ink colors used, a nozzle row corresponding to each of the ink colors is provided to the printing head 28 of the ink-jet printer 20.

In each of the embodiments described above, the ink-jet printer 20 receives a printing signal PS from the computer 88 and performs printing. However, the ink-jet printer 20 need not necessarily receive a printing signal PS from the computer 88 and perform printing. The ink-jet printer 20 may also perform printing according to data stored in the ink jet printer 20 itself, without involvement of the computer 88.

Also, a part of a configuration achieved using hardware in each of the examples described above may be substituted with software. Conversely, a part of a configuration achieved using software may be substituted with hardware.

In an instance in which a part or all of the functions of the present invention is achieved using software, the software (i.e., a computer program) can be provided in a manner in which the software is stored in a recording medium that can be read by a computer. In the present invention, a recording medium that can be read by a computer refers not only to a flexible disk, a CD-ROM, or another portable recording medium, but also to a variety of types of RAM, ROM, or another internal memory in a computer; or a hard disk or another external memory secured to a computer.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a plurality of nozzle rows containing a nozzle row for chromatic ink and a nozzle row for achromatic ink, the nozzle row for chromatic ink having K nozzles for discharging chromatic ink arranged in a first direction (where K is an integer equal to or greater than 2), the nozzle row for achromatic ink having (n·K) nozzles for discharging achromatic ink arranged in the first direction (where n is an integer equal to or greater than 2), and the nozzle rows being arranged along a second direction that intersects with the first direction;

a movement mechanism configured and arranged to cause the nozzle rows to move relative to a print medium in a reciprocating manner along the second direction;

a conveyance mechanism configured and arranged to convey the print medium relative to the nozzle rows along the first direction; and a control part configured to repeatedly perform an image-forming operation in which the nozzle rows discharge ink while the movement mechanism moves the nozzle rows in a forward direction and a reverse direction, and a conveying operation in which the conveyance mechanism conveys the print medium, thereby forming an image on the print medium, in a color region of the image in which the color region contains a chromatic color, the control part being configured to perform the image-forming operation m times (where m is an integer equal to or greater than 2 and equal to or less than n) in which the direction of movement of the nozzle rows switches alternately between the forward direction and the reverse direction, whereby a region of the image having a predetermined width is formed along the first direction, the image-forming operation performed m times including the image-forming operation performed once in which the direction of movement of the nozzle rows is a predetermined direction that is either one of the forward direction or the reverse direction and in which both of the nozzle row for chromatic ink and the nozzle row for achromatic ink are used, and the image-forming operation performed (m−1) times in which only the nozzle row for chromatic ink is used, and in a monochrome region of the image in which the monochrome region does not contain a chromatic color, the control part being configured to perform the image-forming operation once in which only the nozzle row for achromatic ink is used, whereby a region of the image having a predetermined width is formed, the control part being configured to change the direction of movement of the nozzle rows for performing the image-forming operation, in which only the nozzle row for achromatic ink is used, so that the predetermined direction is in the same direction for all color regions in the image.

2. The printing device according to claim 1, wherein among the image-forming operation performed m times by the control part, a first image-forming operation in which the direction of movement of the nozzle rows is in the predetermined direction is the image-forming operation performed once in which both of the nozzle row for chromatic ink and the nozzle row for achromatic ink are used.

3. The printing device according to claim 1, wherein the value of n is an even number.

4. The printing device according to claim 1, wherein in an instance where a region having a predetermined width, being positioned in the monochrome region of the image, and being positioned immediately before a boundary with the color region, has been formed using the image-forming operation in which the direction of movement of the nozzle rows is in the predetermined direction, the control part is configured to perform, immediately after the image-forming operation for forming the region having the predetermined width and being positioned immediately before the boundary, a movement of the nozzle rows in a direction opposite the predetermined direction without use of the nozzle rows, and then to perform image formation in the color region.

5. The printing device according to claim 1, wherein in an instance where a region having a predetermined width, being positioned in the monochrome region of the image, and being positioned immediately before a boundary with the color region, has been formed using the image-forming operation in which the direction of movement of the nozzle rows is in the predetermined direction, the control part is configured to perform, immediately after the image-forming operation for forming the region having the predetermined width and being positioned immediately before the boundary, the image-forming operation in which the direction of movement of the nozzle rows is opposite the predetermined direction, and in which only the nozzle row for chromatic ink is used, as one of the image-forming operations performed (m−1) times for image formation in the color region.

6. A method for controlling a printing device including a plurality of nozzle rows containing a nozzle row for chromatic ink and a nozzle row for achromatic ink, the nozzle row for chromatic ink comprising K nozzles for discharging chromatic ink arranged in a first direction (where K is an integer equal to or greater than 2), the nozzle row for achromatic ink comprising (n·K) nozzles for discharging achromatic ink arranged in the first direction (where n is an integer equal to or greater than 2), and the nozzle rows being arranged along a second direction that intersects with the first direction, a movement mechanism configured and arranged to cause the nozzle rows to move relative to a print medium in a reciprocating manner along the second direction, and a conveyance mechanism configured and arranged to convey the print medium relative to the nozzle rows along the first direction, the method comprising:

forming an image on the print medium by repeatedly performing an image-forming operation in which the nozzle rows discharge ink while the movement mechanism moves the nozzle rows in a forward direction and a reverse direction, and a conveying operation in which the conveyance mechanism conveys the print medium, the forming of the image including in a color region of the image in which the color region contains a chromatic color, performing the image-forming operation m times (where m is an integer equal to or greater than 2 and equal to or less than n) in which the direction of movement of the nozzle rows switches alternately between the forward direction and the reverse direction, whereby a region of the image having a predetermined width is formed along the first direction, the image-forming operation performed m times including the image-forming operation performed once in which the direction of movement of the nozzle rows is a predetermined direction that is either one of the forward direction or the reverse direction and in which both of the nozzle row for chromatic ink and the nozzle row for achromatic ink are used, and the image-forming operation performed (m−1) times in which only the nozzle row for chromatic ink is used, and in a monochrome region of the image in which the monochrome region does not contain a chromatic color, performing the image-forming operation once in which only the nozzle row for achromatic ink is used, whereby a region of the image having a predetermined width is formed, the direction of movement of the nozzle rows for performing the image-forming operation, in which only the nozzle row for achromatic ink is used, being changed so that the predetermined direction is in the same direction for all color regions in the image.

7. A non-transitory computer readable medium having stored thereon a computer program which is executable by a computer for controlling a printing device including a plurality of nozzle rows containing a nozzle row for chromatic ink and a nozzle row for achromatic ink, the nozzle row for chromatic ink comprising K nozzles for discharging chromatic ink arranged in a first direction (where K is an integer equal to or greater than 2), the nozzle row for achromatic ink comprising (n·K) nozzles for discharging achromatic ink arranged in the first direction (where n is an integer equal to or greater than 2), and the nozzle rows being arranged along a second direction that intersects with the first direction, a movement mechanism configured and arranged to cause the nozzle rows to move relative to a print medium in a reciprocating manner along the second direction, and a conveyance mechanism configured and arranged to convey the print medium relative to the nozzle rows along the first direction, the computer program controls the computer to execute function of:

control function for repeatedly performing an image-forming operation in which the nozzle rows discharge ink while the movement mechanism moves the nozzle rows in a forward direction and a reverse direction, and a conveying operation in which the conveyance mechanism conveys the print medium, thereby forming an image on the print medium, the control function being function in which in a color region of the image in which the color region contains a chromatic color, the image-forming operation is performed m times (where m is an integer equal to or greater than 2 and equal to or less than n) in which the direction of movement of the nozzle rows switches alternately between the forward direction and the reverse direction, whereby a region of the image having a predetermined width is formed along the first direction, the image-forming operation performed m times including the image-forming operation performed once in which the direction of movement of the nozzle rows is a predetermined direction that is either one of the forward direction or the reverse direction and in which both of the nozzle row for chromatic ink and the nozzle row for achromatic ink are used, and the image-forming operation performed (m−1) times in which only the nozzle row for chromatic ink is used, and in a monochrome region of the image in which the monochrome region does not contain a chromatic color, the image-forming operation is performed once in which only the nozzle row for achromatic ink is used, whereby a region of the image having a predetermined width is formed, the direction of movement of the nozzle rows for performing the image-forming operation, in which only the nozzle row for achromatic ink is used, being changed so that the predetermined direction is in the same direction for all color regions in the image.

* * * * *